US010002571B1

(12) United States Patent
Zulch

(10) Patent No.: US 10,002,571 B1
(45) Date of Patent: Jun. 19, 2018

(54) LIQUID CRYSTAL DISPLAY INCORPORATING COLOR-CHANGING BACKLIGHT

(75) Inventor: Richard C. Zulch, Orinda, CA (US)

(73) Assignee: Zulch Laboratories, Inc., Occidental, CA (US)

( * ) Notice: Subject to any disclaimer, the term of this patent is extended or adjusted under 35 U.S.C. 154(b) by 479 days.

(21) Appl. No.: 13/031,914

(22) Filed: Feb. 22, 2011

Related U.S. Application Data

(60) Provisional application No. 61/338,972, filed on Feb. 26, 2010.

(51) Int. Cl.
*G09G 3/34* (2006.01)

(52) U.S. Cl.
CPC ..... *G09G 3/34* (2013.01); *G09G 3/3406* (2013.01); *G09G 3/3426* (2013.01)

(58) Field of Classification Search
CPC ..... G02F 1/133753; G02F 1/133707; G02F 1/134309; G02B 6/0018; G02B 6/0028; G02B 6/0068; G02B 6/0076
USPC ..... 345/102, 87, 204, 690; 362/97.1–97.3
See application file for complete search history.

(56) References Cited

U.S. PATENT DOCUMENTS 5,731,794 A * 3/1998 Miyazawa ..... 345/88
9,147,362 B2 * 9/2015 Znamenskiy ..... G09G 3/3413
2006/0109234 A1 * 5/2006 Hong ..... G09G 3/3426 345/102
2008/0109234 A1 * 5/2008 Leach ..... G06Q 10/02 705/37
2008/0291669 A1 * 11/2008 Roberts et al. ..... 362/227
2009/0115803 A1 * 5/2009 Langendijk ..... G09G 3/3413 345/690
2009/0153462 A1 * 6/2009 Kamada ..... G02F 1/133621 345/102
2009/0243993 A1 * 10/2009 Kuga ..... 345/102
2010/0060555 A1 * 3/2010 Lee ..... G09G 3/3426 345/82
2010/0214282 A1 * 8/2010 Whitehead ..... G09G 3/3426 345/214

* cited by examiner

*Primary Examiner* — Joseph Haley
*Assistant Examiner* — Jeffrey S Steinberg
(74) *Attorney, Agent, or Firm* — Van Pelt, Yi & James LLP

(57) ABSTRACT

The system for coordinated color control of LCD backlight and filters comprises a display pixel, a light source driver, a filter driver, and a processor. The light source driver sets a backlight color and a backlight intensity level for the display pixel. The filter driver sets an array of filter levels for three or more filters for the display pixel. The processor is configured to determine the backlight color and the backlight intensity level and the array of filter levels to target a desired color and intensity for the display pixel. The array of filter levels is determined based at least in part on the backlight color and the backlight intensity level.

21 Claims, 17 Drawing Sheets

LIQUID CRYSTAL DISPLAY INCORPORATING COLOR-CHANGING BACKLIGHT

This application claims priority to U.S. Provisional Patent Application No. 61/338,972 entitled LIQUID CRYSTAL DISPLAY INCORPORATING COLOR-CHANGING BACKLIGHT filed 26 Feb. 2010 which is incorporated herein by reference for all purposes.

BACKGROUND OF THE INVENTION

Liquid crystal display (LCD) technology, wherein a backlight is selectively transmitted through an array of pixels each comprising three or more individually controllable color filters, is a dominant means for displaying electronic images. LCD devices have inherent design tradeoffs, including those involving brightness, color gamut, contrast, and power consumption. Filters with narrower wavelength bandwidth provide more saturated colors but admit less light, causing brightness and luminous efficacy to suffer. Increasing filter wavelength bandwidth increases brightness but reduces color gamut. Increasing backlight intensity improves display brightness but increases power consumption and reduces contrast, since LCD filters cannot reduce their transmittance to zero. Traditionally LCD backlights have employed fluorescent lamps, with phosphors chosen in concert with the color filter material. The cost, availability, and characteristics of these physical materials largely constrain LCD design options.

Light-emitting diode (LED) backlight technology is now being used for improved LCD designs. The spectral transmittance of real-world color filters overlap, but the narrow bandwidth of LED emitters can be used to avoid producing light energy in these spectral regions and thus reduce cross-talk among the color components. Another recent improvement is local dimming, wherein the display's pixel array is divided into segments, each lit by an independently-controlled LED backlight whose intensity is adjusted according to the image brightness of its portion of the overall image. The color filters inherently waste energy by blocking light, but local dimming allows the filters to operate at a higher average transmittance, reducing power consumption while increasing contrast. The combination is beneficial because it combines the economical high-resolution of LCD filters with the easy controllability of LED emitters. Unfortunately this approach does not improve the tradeoff between color gamut and luminous efficacy. Producing saturated colors requires light limited to a narrow portion of the visible spectrum. To the extent that the required spectral energy of the image does not match the available spectral energy of the backlight, the color filters must block—and thus waste—considerable amounts of light. What is needed is a better match between backlight spectral energy and the displayed image.

BRIEF DESCRIPTION OF THE DRAWINGS

Various embodiments of the invention are disclosed in the following detailed description and the accompanying drawings.

DETAILED DESCRIPTION

Figure 1A:
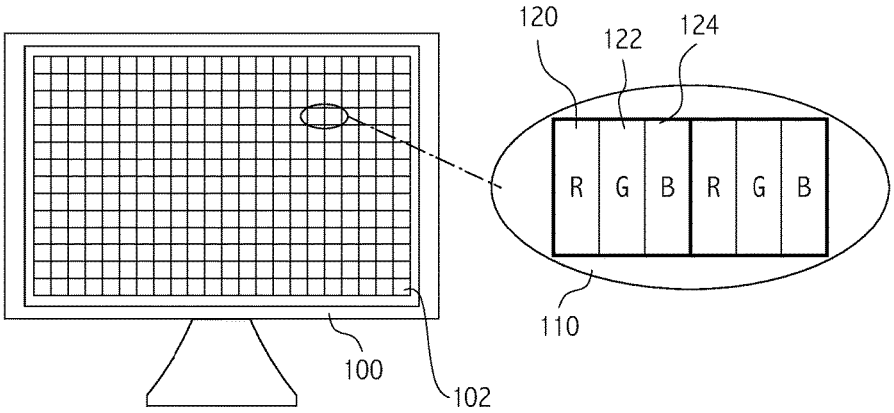
FIG. 1A is a diagram illustrating an embodiment of a display.

The invention can be implemented in numerous ways, including as a process; an apparatus; a system; a composition of matter; a computer program product embodied on a computer readable storage medium; and/or a processor, such as a processor configured to execute instructions stored on and/or provided by a memory coupled to the processor. In this specification, these implementations, or any other form that the invention may take, may be referred to as techniques. In general, the order of the steps of disclosed processes may be altered within the scope of the invention. Unless stated otherwise, a component such as a processor or a memory described as being configured to perform a task may be implemented as a general component that is temporarily configured to perform the task at a given time or a specific component that is manufactured to perform the task. As used herein, the term 'processor' refers to one or more devices, circuits, and/or processing cores configured to process data, such as computer program instructions.

A detailed description of one or more embodiments of the invention is provided below along with accompanying figures that illustrate the principles of the invention. The invention is described in connection with such embodiments, but the invention is not limited to any embodiment. The scope of the invention is limited only by the claims and the invention encompasses numerous alternatives, modifications and equivalents. Numerous specific details are set forth in the following description in order to provide a thorough understanding of the invention. These details are provided for the purpose of example and the invention may be practiced according to the claims without some or all of these specific details. For the purpose of clarity, technical material that is known in the technical fields related to the invention has not been described in detail so that the invention is not unnecessarily obscured.

A system for coordinated color control of LCD backlight and filters is disclosed. The system for coordinated color control of LCD backlight and filters comprises a display pixel, a light source driver, a filter driver, and a processor. The light source driver sets a backlight color and a backlight intensity level for the display pixel. The filter driver sets an array of filter levels for three or more filters for the display pixel. The processor is configured to determine the backlight color and the backlight intensity level and the array of filter levels to target a desired color and intensity for the display pixel. The array of filter levels is determined based at least in part on the backlight color and the backlight intensity level.

Backlight color is determined according to an image to be displayed, with color filters correspondingly adjusted to produce desired colors for each pixel. In some embodiments, the system for coordinated color control comprises a processor and an array of one or more segments, each comprising a color-changeable backlight and an array of pixels. In some embodiments, the color-changeable backlight comprises a set of illuminant types that are each associated with a spectral power distribution. In some embodiments, the array of pixels each comprise a set of filter types that are each associated with a spectral transmittance. In some embodiments, the processor is configured to determine, based on a supplied image, an illuminant drive level set for each segment and a filter drive level set for each pixel.

An example LCD comprising an LED-based red-green-blue (RGB) backlight and appropriate RGB filters displays a white color when all filters are maximally transparent and the backlight is at full brightness. A deeply saturated blue with xy chromaticity coordinates (0.207, 0.160) requires the red filter to be 15% transparent, the green filter 18%, and the blue filter 100%. These filter settings transmit approximately 21% of the luminous intensity of the white. A segment of the supplied image containing mostly bluish colors allows the backlight to be shifted towards blue, allowing the red and green filters to be more transparent while still generating the same color perception. Reducing the red backlight to 43% and the green backlight to 38% allows the red and green filters to be more transparent at 37% and 49% respectively. The luminous intensity of the backlight is reduced to 45%, but the combined filter transmittance increases to 50%, resulting in a 1% increase in combined luminous intensity and a 40% savings in backlight power. Shifting the backlight color towards blue also increases color gamut by reducing crosstalk, i.e. reducing the proportion of red and green light transmitted through the blue filter.

Images having color in a smaller hue range enable greater optimization, while more segments increase the opportunities for finding portions of the image having a small hue range. Although not every image can be optimized to the same degree, a substantial power improvement is possible on average. In various embodiments, the power improvement benefits energy consumption (e.g., improved luminous efficacy), display brightness (e.g., using brighter backlights), image quality (e.g., using narrower filters), thermal management, and/or any other benefits in any combination.

In various embodiments, light is generated and filter transmittance is set through coordinated color control based on a supplied image and its characteristics (e.g. dominant colors, intensity, etc.) where one or more of the following are targeted: brightness is optimized, filter transmittance is maximized, backlight power consumption is minimized for a given brightness requirement, temporal transitions between different backlight colors are accomplished without distracting illuminant changes, where the required computations are practicable using minimal computing resources, and/or any other appropriate criteria are targeted.

In some embodiments, the system for coordinated color control of LCD backlight and filters is used as part of a system for display—for example, a television, a computer monitor, a hand held device display (e.g., phone, video player, etc.), or a projector—for which the overall system's performance is improved or balanced based on the addition of the coordinated color control system (e.g., increased brightness, lower power consumption, better battery life, lower battery performance requirements, etc.).

FIG. 1A is a diagram illustrating an embodiment of a display. In various embodiments, the display of FIG. 1A comprises one or more of the following: a monitor, a television, a hand held device display, a computer display, a projection display, or any other appropriate display. In the example shown, a graphical display device (e.g., desktop display device 100) generates colors according to a video, image, picture, and/or other appropriate data source using three colors per pixel. Desktop display device 100 incorporates grid 102 comprising square pixels. Detail 110 shows two such pixels, each comprising three filters of different types: Red filter 120, Green filter 122, and Blue filter 124. Display data is assembled into a rectangular layout and color and intensity determined for each pixel. A coordinated color controller converts an input data of a target pixel color into necessary filter control signals to achieve filter proportions, based on the backlight available behind each pixel, that result in the target pixel color and intensity being produced by the pixel of desktop display device 100. Thus, calculated filter transmittance levels are output by the controller with appropriate addressing and timing to cause the desired generated colored light to be emitted from each pixel.

In some embodiments, each pixel of detail 110 comprises four or more filter types. In some embodiments, Red filter 120, Green filter 122, and Blue filter 124 are arranged in a different order. In various embodiments, Red filter 120, Green filter 122, and Blue filter 124 are arranged in one of the following configurations: triangular, rectangular, square, or any other appropriate configuration. In some embodiments, Red filter 120, Green filter 122, and Blue filter 124 are of different sizes or shapes from each other—for example, Red filter 120 is smaller than Green filter 122, and Blue filter 124 is round whereas Green filter 122 is oval.

Figure 1B:
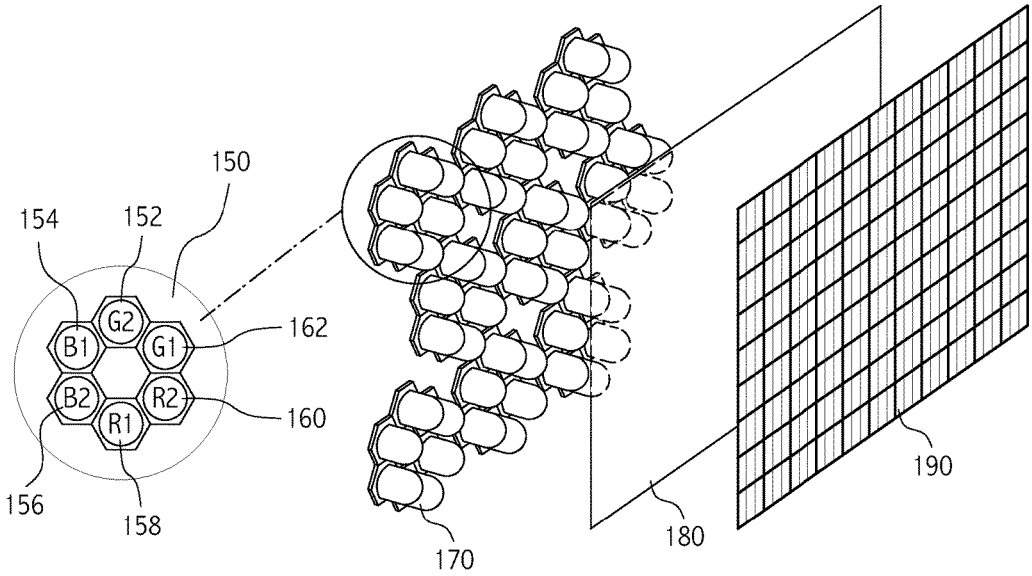
FIG. 1B is a diagram illustrating an embodiment of an interior structure of an LCD.

FIG. 1B is a diagram illustrating an embodiment of an interior structure of an LCD. In the example shown, for clarity numerous components of an actual physical display are omitted or are not accurately scaled in size. In some embodiments, FIG. 1B shows interior components of the display of FIG. 1A where grid 190 corresponds to grid 102 of FIG. 1A. In the example shown, backlight 170 incorporates light sources, each controllable as to color. Detail 150 shows one such light source comprising six illuminants of different types: Red-1 158, Red-2 160, Green-1 162, Green-2 152, Blue-1 154 and Blue-2 156. Optical combiner 180 ensures that generated light is uniformly additively mixed (e.g., the six illuminants are combined to produce one pixel in the display). Grid 190 comprises square pixels each comprising color filters.

In various embodiments, the illustrated components are of different sizes, shapes, and arrangements. In some embodiments, backlight 170 comprises a single light source. In some embodiments, light source shown in detail 150 comprises three or more illuminant types. In some embodiments, each light source shown in detail 150 comprises two or more illuminants of the same illuminant type. In various embodiments, illuminants shown in detail 150 are arranged in one of the following configurations: triangular, rectangular, square, or any other appropriate configuration. In some embodiments, two or more of illuminants 152-162 are incorporated into a single package. In some embodiments, optical combiner 180 is incorporated into each light source shown in detail 150. In some embodiments, optical combiner 180 is omitted. In some embodiments, each light source of backlight 170 illuminates two or more pixels of grid 190. In some embodiments, each pixel receives substantially all of its illumination from a single light source of backlight 170. In some embodiments, some pixels receive a combination of light from two or more light sources of backlight 170.

Each light source is associated with a means for adjusting light intensity emitted by each illuminant type in the range from zero intensity through maximum intensity according to a drive level ranging numerically from 0 through 1. Each pixel is associated with a means for adjusting light transmittance through each color filter type in the range from maximum opacity through minimum opacity according to a drive level ranging numerically from 0 through 1. An array containing drive levels corresponding to each illuminant in a light source or to each filter in a pixel is referred to herein as a "drive level set".

Figure 2A:
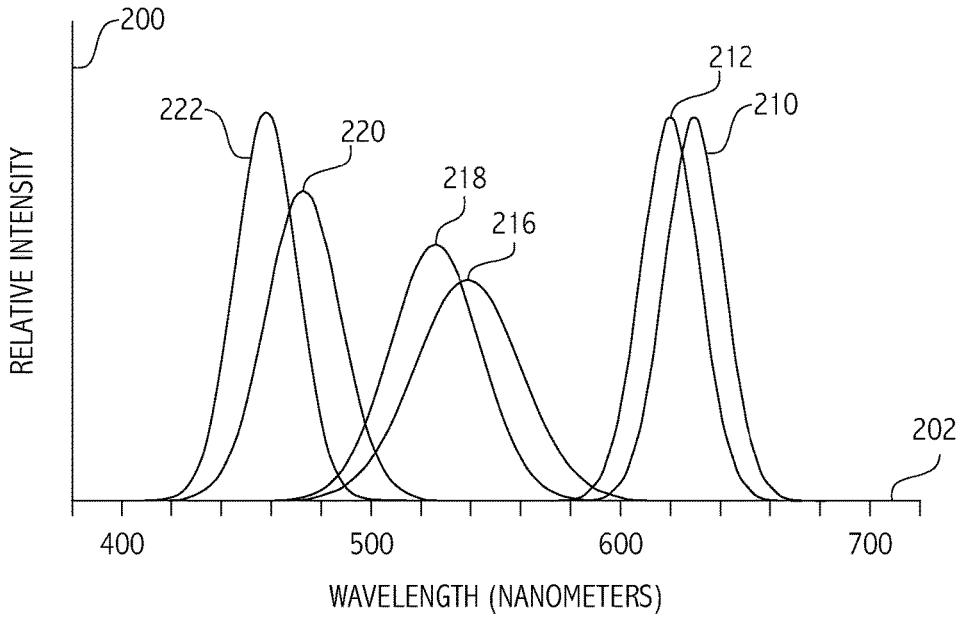
FIG. 2A is a graph illustrating an embodiment of illuminant relative intensity.

FIG. 2A is a graph illustrating an embodiment of illuminant relative intensity. In the example shown, illuminant Relative Intensity is graphed on vertical axis 200 versus illuminant emitted visible Wavelength on horizontal axis 202. Six illuminant types are plotted: Red-1 210, Red-2 212, Green-1 216, Green-2 218, Blue-1 220, and Blue-2 222. Each illuminant plot is normalized to have a unit area of 1.0 so bandwidth and dominant wavelength can be compared in the graph, but total intensity cannot.

For purposes of color mixing, intensity values need not be calibrated to standard units since only their relative proportions are important. The lighting art utilizes a plethora of related units depending upon whether the light is being measured upon emission from a source, on reflection from objects, as an angular quantity, weighted by human perception, etc. For purposes of color mixing it is sufficient to characterize illuminants according to radiometric units, which are independent of human perception. For example, illuminant output can be characterized by radiant flux, radiant intensity, or radiance, as long as the measurements are made consistently. The result of color mixing is best described in terms of photometric units such as luminous flux, luminous intensity, or luminance. For clarity, the term "intensity" is used herein to describe optical output as a radiometric quantity, both for purposes of characterizing an illuminant or describing control of its output level. The terms "brightness" and "luminous intensity" are used herein interchangeably to describe optical output as a photometric quantity, weighted by human perception. Similarly "transmittance" is used herein to describe the fraction of incident light that passes through a filter as a radiometric quantity, while "luminous transmittance" is used herein to describe the fraction as a photometric quantity, weighted by human perception. Consistently substituting related units does not affect the disclosed color mixing. The term "color" is used herein to describe human color perception, so a change in color may involve a change in chromaticity, a change in luminous intensity, or a change in both.

In various embodiments, one or more of the following different instruments and techniques are used to characterize illuminant types: a spectrograph, a spectroscope, a spectrometer, an optical spectrum analyzer, a radiometer, a photometer, and/or any other appropriate instrument of photometry and radiometry. In some embodiments, the illuminant type characterization is derived from manufacturer data sheets. Although this disclosure uses the CIE 1931 color space for consistency in its illustrations and examples, it should be noted that any other methods of predicting color mixtures could be used, including without limitation those with a different color space, observer model, or color matching functions. In some embodiments, the observer model corresponds to the capabilities of cameras or other optical equipment.

Figure 2B:
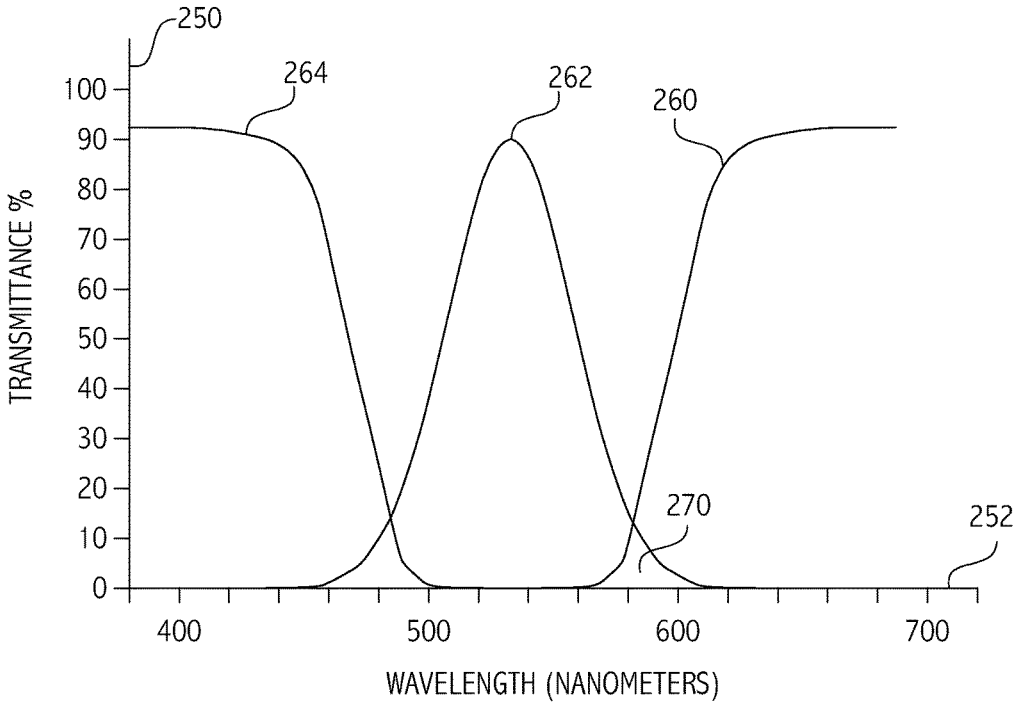
FIG. 2B is a graph illustrating an embodiment of idealized color filter transmittance.

FIG. 2B is a graph illustrating an embodiment of idealized color filter transmittance. In the example shown, filter Transmittance is graphed on vertical axis 250 versus visible Wavelength on horizontal axis 252. Three filters are plotted as red 260, green 262, and blue 264. Overlap 270 can cause crosstalk between color channels.

Figure 3A:
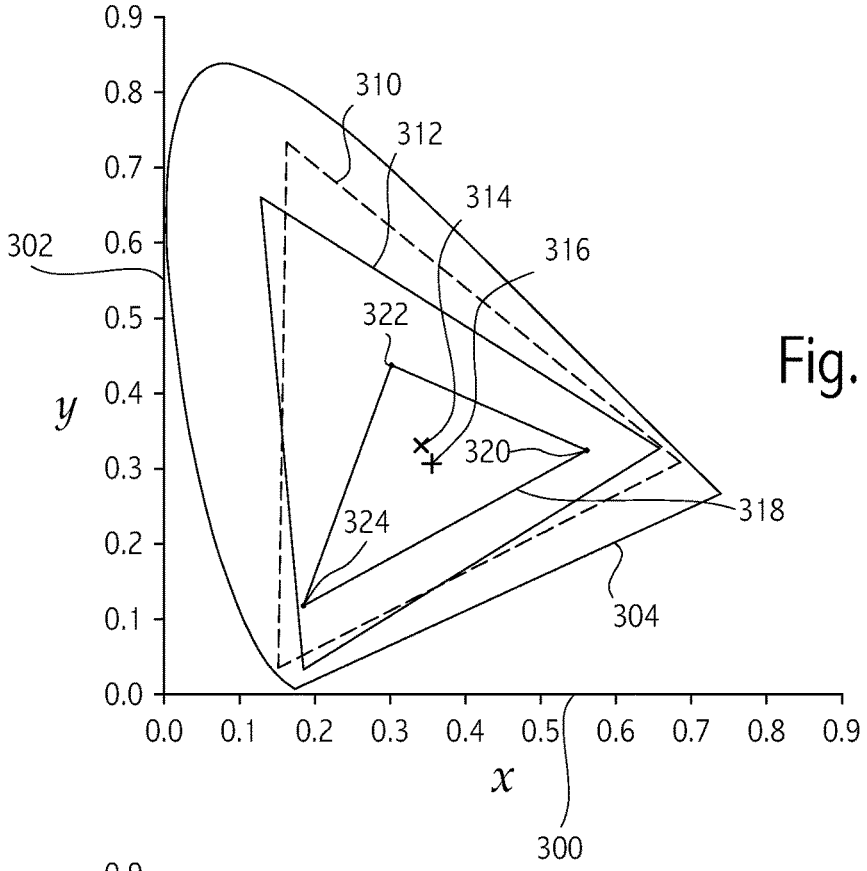
FIG. 3A is a plot illustrating an embodiment of the CIE 1931 xy chromaticity diagram showing gamuts relevant to an LCD display.

FIG. 3A is a plot illustrating an embodiment of the International Commission on Illumination (CIE) 1931 xy chromaticity diagram showing gamuts relevant to an LCD display. In the example shown, the chromaticity diagram has horizontal axis 300 corresponding to x, vertical axis 302 corresponding to y, and human color gamut boundary shown by closed curve 304. Triangle 310 shows a color gamut for a backlight with three illuminant types, where each vertex coordinate is determined from a spectral power distribution of its corresponding illuminant type. Triangle 312 shows a color gamut for a pixel with three filter types, where each vertex coordinate is determined from a spectral transmittance of its corresponding filter type as applied to the combined spectral power distribution of the backlight with all illuminants at full brightness. Triangle 318 shows a constraint color gamut chosen according to desired display color reproduction capability. Associated with each vertex 320, 322, and 324 is a minimum luminous flux target used by the color control system to prevent optimization from overly reducing image quality or brightness. Maximum intensity point 314 shows a chromaticity of the backlight with all illuminants set to maximum intensity. Maximum transmittance point 316 shows a chromaticity of the pixel with all filters set to maximum transmittance.

For purposes of reproducing images on a light-emitting display, the lighting art uses the term "white point" to refer to the chromaticity of a white reference point. The white point of a conventional display typically approximates closely the chromaticity of the light corresponding to all color components (e.g. red, green, and blue) at their individual maximum drive level. For purposes of coordinating color-changing backlights with superimposed color filters this correspondence no longer holds because the chromaticity resulting from all color components at their maximum drive level may vary significantly from "white". The white point of such a display is more appropriately characterized as an arbitrary choice. For clarity herein, the term "maximum intensity point" refers to the light generated when all illuminants of a set are set at their maximum intensity (i.e. drive level 1.0), and the term "maximum transmittance point" refers to the light generated when all filters of a pixel are set at their maximum transmittance (i.e. drive level 1.0) for a given illumination source.

Figure 3B:
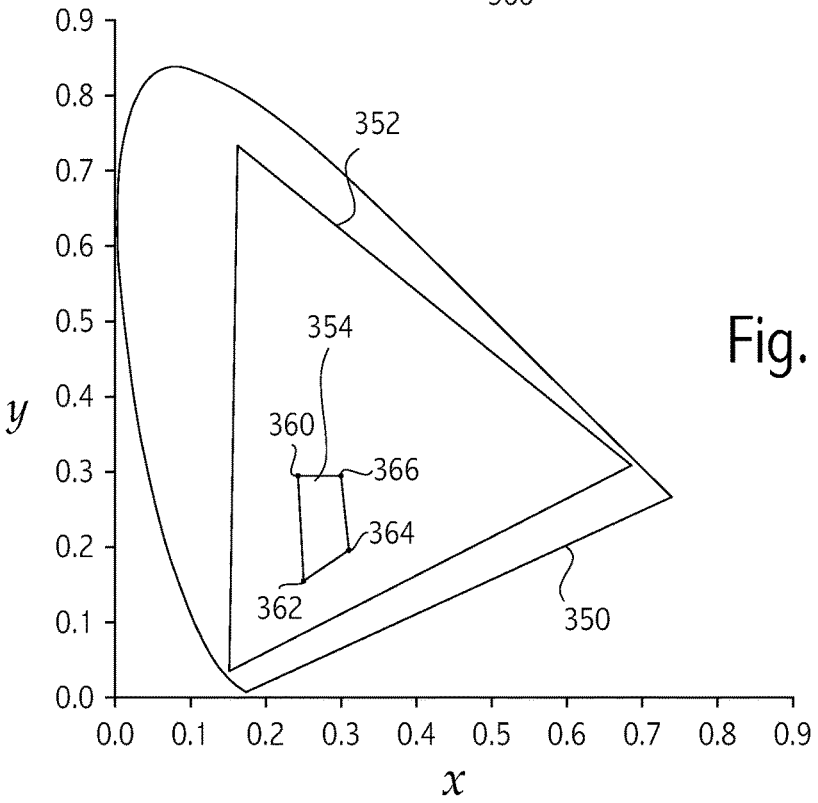
FIG. 3B is a plot illustrating an embodiment of the CIE 1931 xy chromaticity diagram showing an allowable backlight gamut.

FIG. 3B is a plot illustrating an embodiment of the CIE 1931 xy chromaticity diagram showing an allowable backlight gamut. In the example shown, the human color gamut boundary is shown by closed curve 350 and the backlight color gamut is shown by triangle 352. Polygon 354 comprises a region of allowable backlight colors such that the luminous flux targets of constraint gamut 314 of FIG. 3A can be maintained. Vertices 360, 362, 364, and 366 are each computed using combinations of minimum allowable backlight illuminant type drive levels computed by a color analysis process.

Figure 4A:
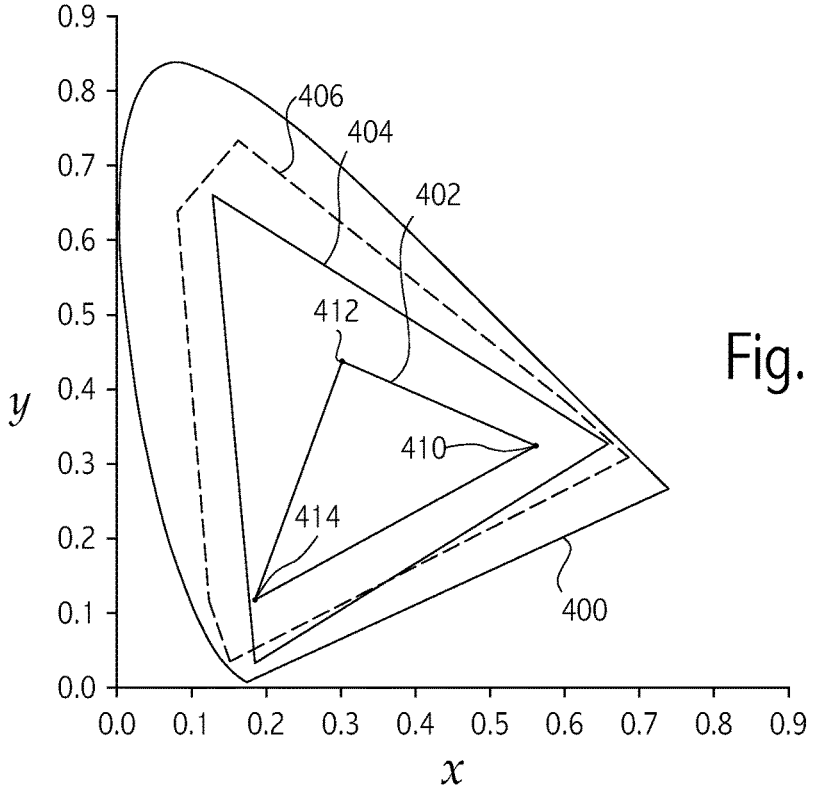
FIG. 4A is a plot illustrating an embodiment of the CIE 1931 xy chromaticity diagram showing gamuts relevant to an LCD display.

FIG. 4A is a plot illustrating an embodiment of the CIE 1931 xy chromaticity diagram showing gamuts relevant to an LCD display. In the example shown, the human color gamut boundary is shown by closed curve 400. Polygon 406 shows a color gamut for a backlight with six illuminant types, where each vertex coordinate is determined from a spectral power distribution of its corresponding illuminant type. Triangle 404 shows a color gamut for a pixel with three filter types, where each vertex coordinate is determined from a spectral transmittance of its corresponding filter type as applied to the combined spectral power distribution of the backlight with all illuminants at full brightness. Triangle 402 shows a constraint color gamut chosen according to desired display color reproduction capability. Associated with each vertex 410, 412, and 414 is a minimum luminous flux target used by the color control system to prevent optimization from overly reducing image quality. In various embodiments, the backlight gamut comprises four, five, seven, or more vertices corresponding to an equal number of illuminant types. In some embodiments, the pixel gamut comprises four or more vertices corresponding to an equal number of filter types.

Figure 4B:
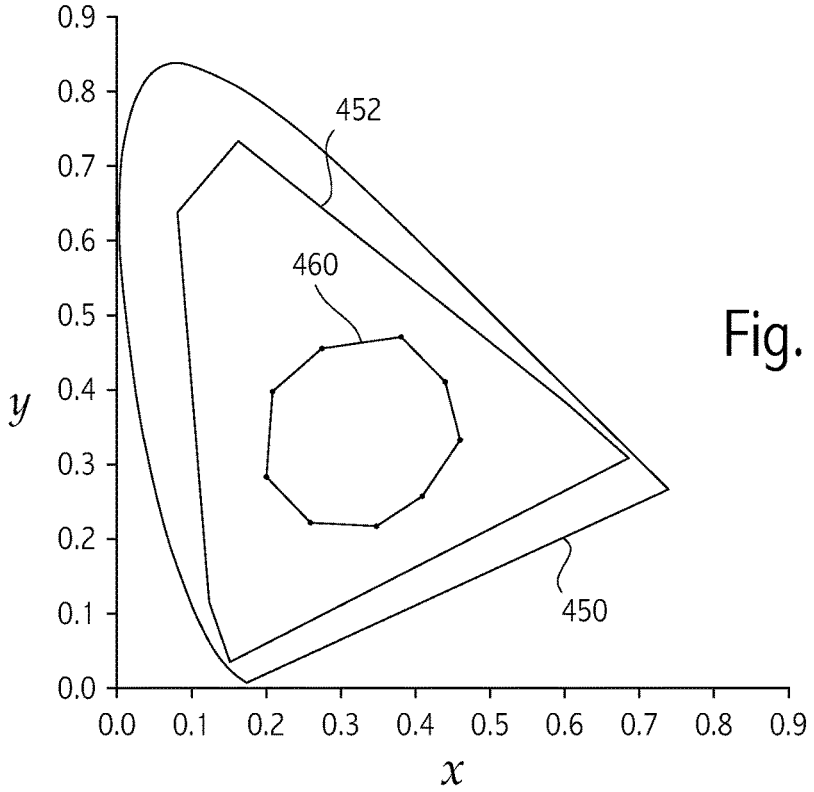
FIG. 4B is a plot illustrating an embodiment of the CIE 1931 xy chromaticity diagram showing an allowable backlight gamut.

FIG. 4B is a plot illustrating an embodiment of the CIE 1931 xy chromaticity diagram showing an allowable backlight gamut. In the example shown, the human color gamut boundary is shown by closed curve 450 and the six-color backlight gamut is shown by triangle 452. Polygon 460 comprises a region of allowable backlight colors such that the luminous flux targets of constraint gamut 402 of FIG. 4A can be maintained. Vertices of polygon 460 are computed using combinations of minimum allowable backlight illuminant type drive levels computed by a color analysis process.

Figure 5A:
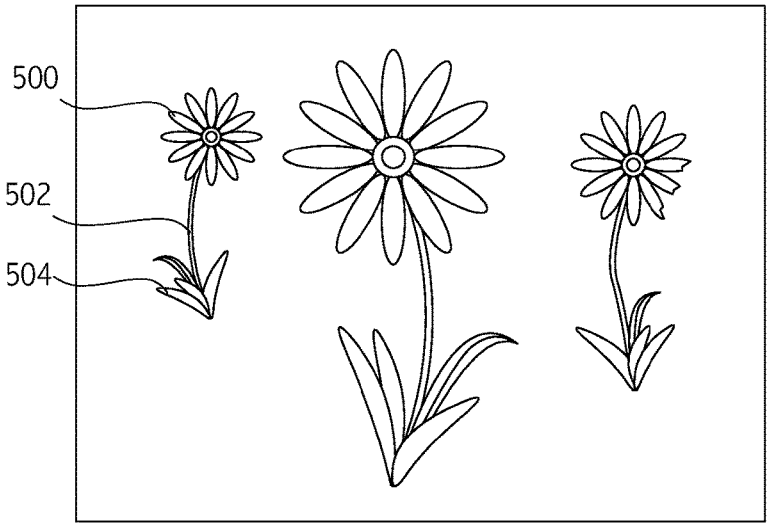
FIG. 5A is an example image portraying flowers as might be supplied for display.

FIG. 5A is an example illustrating an image portraying flowers as might be supplied for display. In the example shown, this is a black-and-white line drawing representation of a color image with the flowers having differently colored petals 500, stem 502, and leaves 504.

Figure 5B:
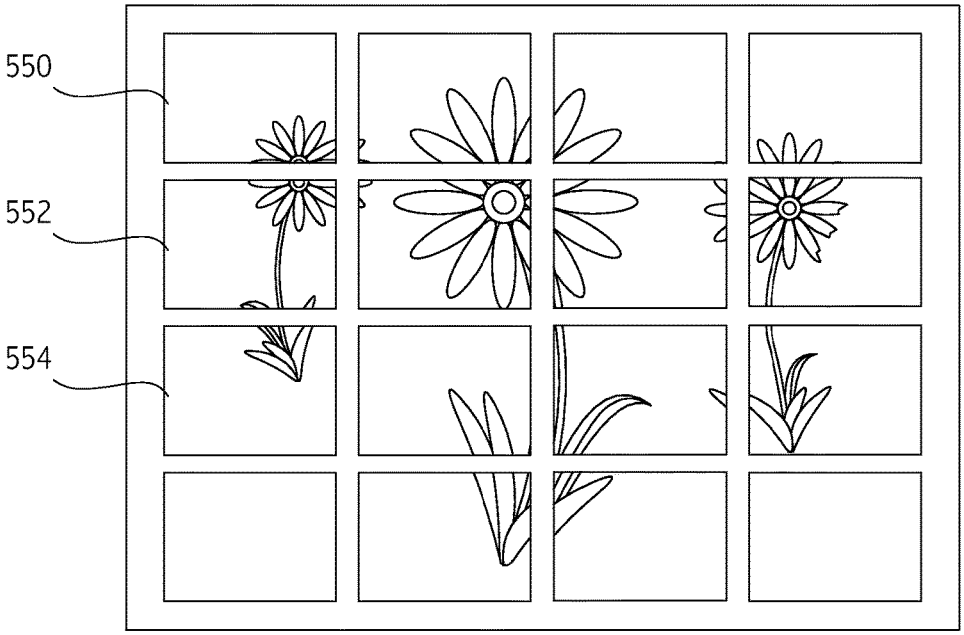
FIG. 5B is a diagram illustrating an embodiment of a segmentation of an image as might be supplied for display.

FIG. 5B is an example illustrating a result of dividing the image of FIG. 5A into 16 separate segments. In the example shown, this is a black-and-white line drawing representation of a set of color images. Segment 550 shows a segment containing petals without any stem. Segment 552 shows a segment containing a combination of petals, stem, and leaves. Segment 554 shows a segment containing only stem and leaves. Segments 550-554 have different color imagery and thus different color gamut requirements. In some embodiments, a different constraint gamut is determined for each segment to individually optimize the combination of backlight and filters. In some embodiments, the entire image is treated as a single segment.

Figure 6:
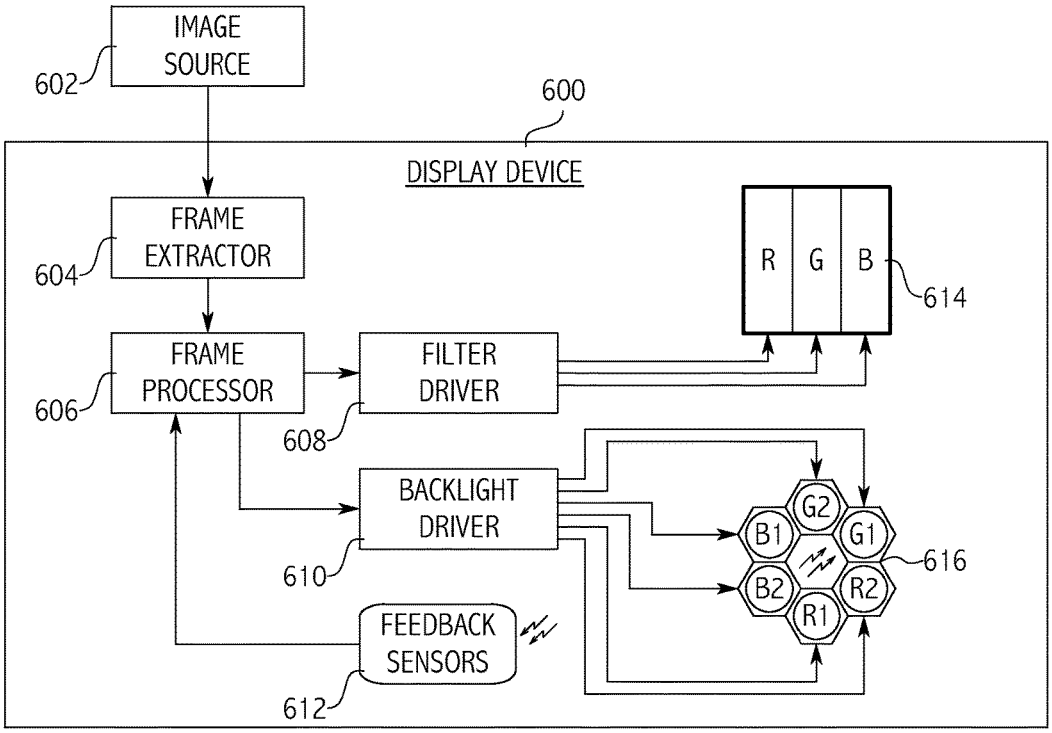
FIG. 6 is a block diagram illustrating an embodiment of a system capable of coordinated color control for LCD backlights and filters.

FIG. 6 is a block diagram illustrating an embodiment of a system capable of coordinated color control for LCD backlights and filters. In the example shown, Display Device 600 is connected to Image Source 602. Within Display Device 600, Frame Extractor 604 is connected to Frame Processor 606. Frame Processor 606 is connected to Filter Driver 608, Backlight Driver 610, and optional Feedback Sensors 612. Filter Driver 608 is connected to the filters of example pixel 614. Backlight Driver 610 is connected to the illuminants of example light source 616.

Display Device 600 accepts image data from Image Source 602 and obtains a single image (if necessary, e.g. from a video image source) using Frame Extractor 604. Each pixel of display device 600 is illuminated by a corresponding compound light source (e.g., Light Source 616) whose light passes through one or more filters (e.g., filters 614). Frame Processor 606 operates on a single image to determine an optimized drive level set for each light source and each pixel. Backlight Driver 610 uses appropriate timing, addressing, and multiplexing to control each backlight light source, such as example light source 616. Filter Driver 608 uses appropriate timing and multiplexing to control each pixel, such as example pixel 614. Optional Feedback Sensors 612 obtains temperature and light emission data to compensate for backlight illuminant drift or aging.

In some embodiments, Feedback Sensors 612 is optically connected to backlight light sources. In some embodiments, Feedback Sensors 612 is thermally connected to backlight light sources. In some embodiments, Feedback Sensors 612 comprises a separate external light-measuring device. In various embodiments, a connection to the separate external light-measuring device comprises a wireless connection, a wired connection, USB, Bluetooth, or any other appropriate connection. In some embodiments, Light Source 616 comprises a stabilized color-changing subsystem that maintains a constant color specification. In some embodiments, one stabilized color-changing subsystem comprises two or more light sources, individually controllable as to color.

Figure 7:
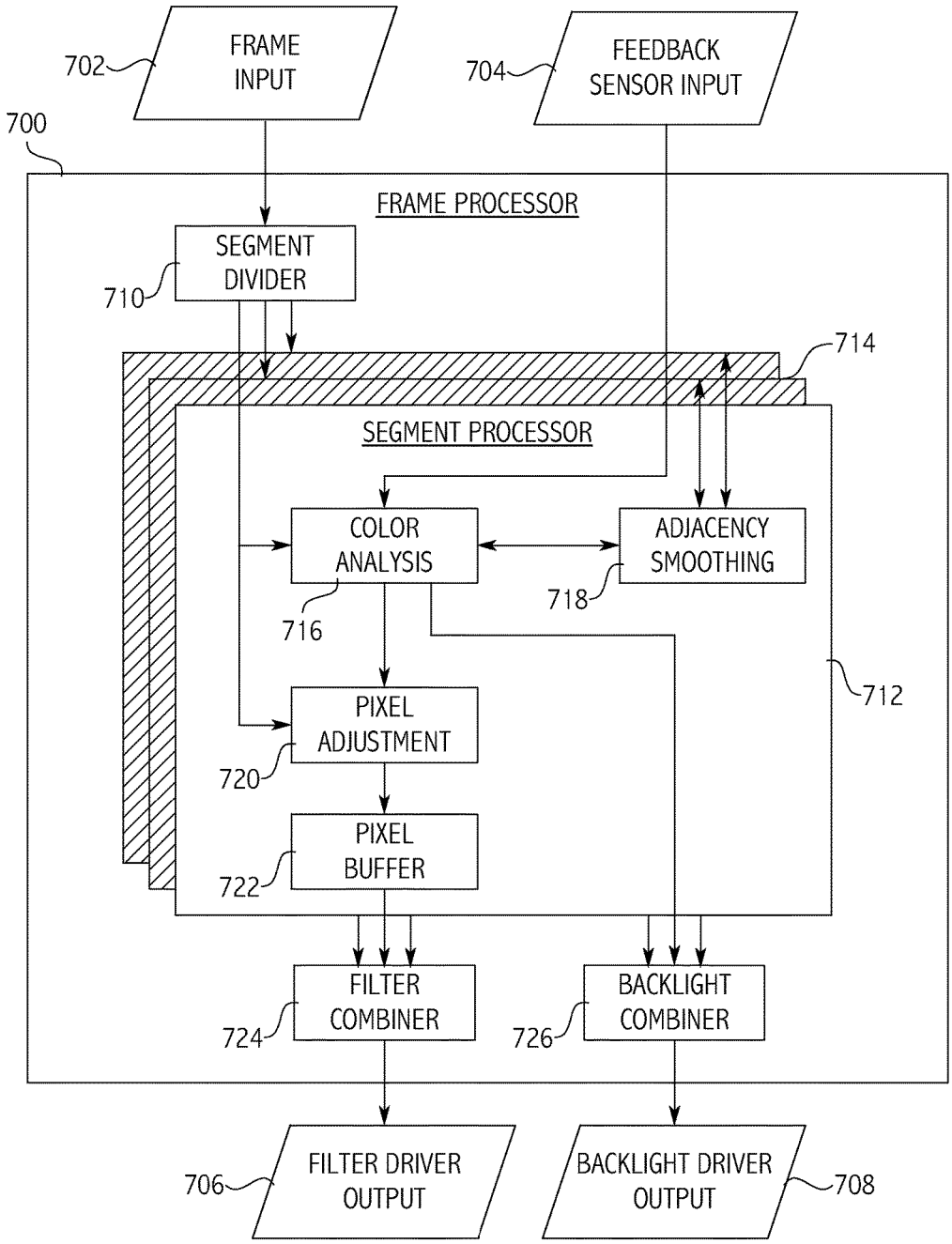
FIG. 7 is a block diagram illustrating an embodiment of a system capable of coordinated color control for LCD backlights and filters.

FIG. 7 is a block diagram illustrating an embodiment of a system capable of coordinated color control for LCD backlights and filters. In some embodiments, FIG. 7 is used to implement elements of FIG. 6 (e.g. frame processor 700 is used to implement 606.) In the example shown, Frame Processor 700 is connected to Frame Input 702, Feedback Sensor Input 704, Filter Driver Output 706, and Backlight Driver Output 708. Within Frame Processor 700, Segment Divider 710 is connected to Segment Processor 712 and optional parallel segment processors 714. Segment Processor 712 and optional parallel segment processors 714 are connected to Filter Combiner 724 and Backlight Combiner 726. Filter Combiner 724 is connected to Filter Driver Output 706. Backlight Combiner 726 is connected to Backlight Driver Output 708. Within Segment Processor 712, Color Analysis 716 is connected to Feedback Sensor Input 704, Segment Divider 710, Pixel Adjustment 720, Backlight Combiner 726, and Adjacency Smoothing 718. Pixel Adjustment 720 is connected to Segment Divider 710 and Pixel Buffer 722. Pixel Buffer 722 is connected to Filter Combiner 724.

Segment Divider 710 is responsible for receiving images from Frame Input 702, dividing each image into appropriate segments, and issuing these to Segment Processor 712 and optional parallel segment processors 714. Color Analysis 716 evaluates color content of the image segment, determines backlight illuminant spectral power distribution, optionally using information from Feedback Sensors Input 704, negotiates backlight color choice with adjacent segments via Adjacency Smoothing 718, issues a backlight color selection to Backlight Combiner 726, and issues color conversion instructions to Pixel Adjustment 720. Pixel Adjustment 720 accepts image data from Segment Divider 710, applies color conversion instructions from Color Analysis 716, and outputs resulting image data to Pixel Buffer 722. Pixel Buffer 722 stores image data from Pixel Adjustment 720 and outputs it with appropriate timing and multiplexing to Filter Combiner 724.

In various embodiments, Frame Processor 700 is implemented using a microprocessor, a microcontroller, a PLD, an FPGA, an ASIC, a DSP, discrete logic, or any other appropriate computational hardware in any combination. In some embodiments, Frame Processor 700 uses special purpose accelerator hardware. In some embodiments, Frame Processor 700 is implemented as a software process within a larger system with one or more processors and/or potentially with one or more virtualized systems. In some embodiments, controller 600 processes multiple images simultaneously. In some embodiments, Frame Processor 700 is connected to a physical user interface consisting of indicator lights, knobs, switches, displays, and other control panel elements in any combination. In some embodiments, Frame Processor 700 employs fixed-point arithmetic. In some embodiments, Frame Processor 700 employs floating-point arithmetic. In some embodiments, Frame Processor 700 employs integer arithmetic. In some embodiments, Segment Processor 712 sequentially processes multiple image segments for each frame. In some embodiments, Segment Processor 712 processes all image segments for each frame. In some embodiments, there are one or more optional parallel segment processors 714 which each process one or more image segments in parallel with Segment Processor 712. In some embodiments, segments are processed recursively where each deeper recursion level operates on a smaller image segment. In some embodiments, segments are processed in left-to-right then top-to-bottom order. In some embodiments, segments are not processed in any defined order. In some embodiments, segments are processed in a prioritized order dependent upon color and/or intensity characteristics of the image.

Figure 8:
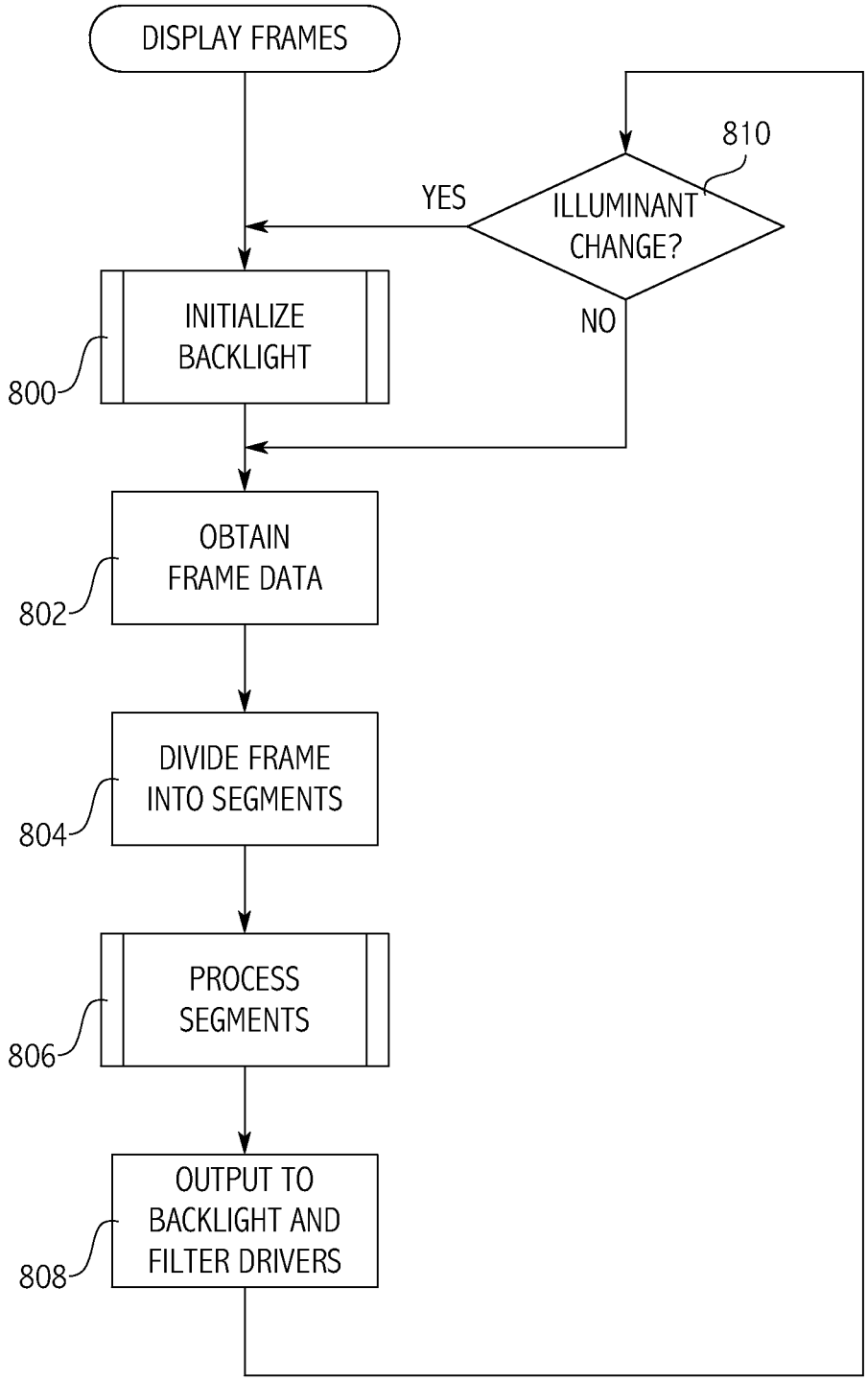
FIG. 8 is a flow chart illustrating an embodiment of a process for coordinating color among LCD backlights and filters.

FIG. 8 is a flow chart illustrating an embodiment of a process for coordinating color among LCD backlights and filters. In some embodiments, the process of FIG. 8 is used to implement Frame Processor 700 of FIG. 7. In the example shown, Initialize Backlight 800 determines current backlight color and intensity characteristics. Obtain Frame Data 802 accepts the next frame in a video stream, or a still image. Divide Frame Into Segments 804 creates one or more image segments to be processed separately and routes them to one or more segment processors. Process Segments 806 determines backlight and filter drive level sets based on segment image data. Output To Backlight And Filter Drivers 808 sends the drive level sets to the drivers for the physical hardware. Illuminant Change 810 tests whether the backlight illuminants have drifted or aged beyond a threshold. If yes, Initialize Backlight 800 is performed again. If no, the process repeats starting with Obtain Frame Data 802.

In some embodiments, Divide Frame Into Segments 804 creates image segments with pixel dimensions and layout that correspond to the pixel dimensions and layout of the backlight and the filter grid in the display hardware. In some embodiments, the image segments are multiples or submultiples of these corresponding pixel dimensions and layout. In some embodiments, there is only one segment per image. In various embodiments, segment pixel dimensions and layout depend in part on factors that affect timing including any of the following: required frame rate, image source rate, image complexity, capability of the segment processor(s), and/or any other appropriate timing factors in any combination.

Figure 9:
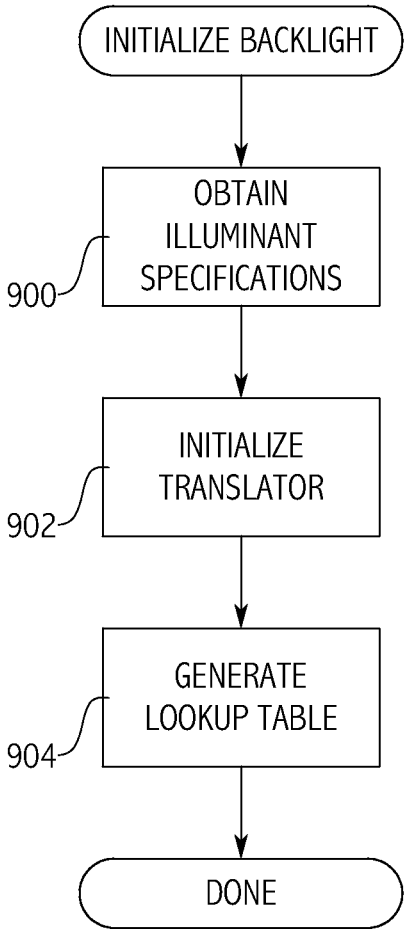
FIG. 9 is a flow chart illustrating an embodiment of a process for computing backlight illuminant data useful for coordinated color control, based upon current backlight illuminant color and intensity characteristics.

FIG. 9 is a flow chart illustrating an embodiment of a process for computing backlight illuminant data useful for coordinated color control, based upon current backlight illuminant color and intensity characteristics. In some embodiments, the process of FIG. 9 is used to implement 800 of FIG. 8. In the example shown, Obtain Illuminant Specifications 900 determines spectral power distributions of backlight illuminant types. Initialize Translator 902 uses backlight illuminant type spectral power distribution data to create translator data structures useful for converting a selected backlight chromaticity to the corresponding illuminant type drive levels that generate light of that chromaticity, and for converting a selected filter chromaticity to the corresponding filter type drive levels that transmit light of that chromaticity for a given backlight chromaticity. Generate Lookup Table 904 uses the translator data structures to create a lookup table useful for accelerating conversion of chromaticity to illuminant type drive levels.

In some embodiments, Obtain Illuminant Specifications 900 uses a pre-programmed data table containing the spectral power distributions of the backlight illuminants. In some embodiments, Obtain Illuminant Specifications 900 uses an optical measurement from Feedback Sensors 612 of FIG. 6. In some embodiments, Obtain Illuminant Specifications 900 uses a temperature measurement from Feedback Sensors 612 of FIG. 6. In some embodiments, Obtain Illuminant Specifications 900 uses predicted aging factors associated with the backlight illuminants.

In some embodiments, Initialize Translator 902 performs the following calculations to determine a correlation matrix and a proportion matrix associated with the backlight illuminant types and the filter types. In Equation 1, correlation matrix V is calculated from N illuminant types each with a spectral power distribution of I, and M filters each with a spectral transmittance T in the range [0 . . . 1]. Proportion matrix P represents the ratio of each member of V to the total intensity of all illuminants for the corresponding filter.

$$V_{i,j} = \frac{\sum_{\lambda} I_j(\lambda) T_i(\lambda)}{\sum_{\lambda} I_j(\lambda)} \qquad \text{Equation 1}$$

$$P_{i,j} = \frac{V_{i,j}}{\sum_{k=1}^{N} V_{i,k}}$$

$$i = [1 \ldots M],\ j = [1 \ldots N]$$

Each row of V and P correspond to a filter and each column to an illuminant. For example, $V_{2,3}$ contains the spectral power distribution of illuminant 3 as viewed through filter 2. In some embodiments, correlation matrices V and/or P are pre-calculated and stored in a data memory.

In some embodiments, Initialize Translator 902 performs the following calculations to implement an intensity translator that converts a chromaticity to an illuminant drive level set and a luminous intensity when all filters have drive level 1.0. Equation 2 uses standard color matching functions to calculate an XYZ tristimulus value for each illuminant type as transmitted through the filters. In some embodiments, tristimulus values $XYZ^I$ for each illuminant type are pre-calculated and stored in a data memory.

$$\begin{cases} X_j^I = \sum_{i=1}^{M} \sum_{\lambda} V_{i,j}\bar{x}(\lambda) \\ Y_j^I = \sum_{i=1}^{M} \sum_{\lambda} V_{i,j}\bar{y}(\lambda) \\ Z_j^I = \sum_{i=1}^{M} \sum_{\lambda} V_{i,j}\bar{z}(\lambda) \end{cases} \quad \text{Equation 2}$$

$$j = [1 \ldots N]$$

For the case where N=3, i.e. there are 3 illuminant types, Equation 3 uses the $XYZ^I$ tristimulus values calculated by Equation 2 to convert an xy chromaticity C to an illuminant drive level set $D^I$ arranged as a column vector of rank 3, and a luminous intensity $A^I$ representing the maximum brightness at which C can be generated by the illuminant types as transmitted through the filters.

$$D^I = \begin{bmatrix} X_1^I & X_2^I & X_3^I \\ Y_1^I & Y_2^I & Y_3^I \\ Z_1^I & Z_2^I & Z_3^I \end{bmatrix}^{-1} \begin{bmatrix} C_x \\ C_y \\ 1 - C_x - C_y \end{bmatrix} \quad \text{Equation 3}$$

$$A^I = [\, Y_1^I \;\; Y_2^I \;\; Y_3^I \,] D^I$$

For the case where N>3, i.e. there are 4 or more illuminant types, the proportions of each illuminant type necessary to generate a desired color can be determined by computing a mapping in whole or in part, where the mapping associates with each chromaticity in the gamut a drive level set. The mapping can be visualized as a set of three-dimensional surfaces sharing a common xy plane containing every chromaticity in the gamut, where the z-axis value of each surface specifies the drive level necessary for its illuminant type so that the combined illuminants generate the chromaticity at each xy chromaticity point. The set of three-dimensional surfaces is constructed for N illuminant types by a following process. First a circular order of the illuminant types is created according to their hue angle, i.e., the angle of a line from CIE chromaticity coordinate (⅓, ⅓) to the chromaticity coordinate of the illuminant type. The process proceeds by recording the chromaticity coordinate resulting from a combination of all illuminant types at drive level 1.0, then recording the N chromaticity coordinates resulting from each combination of illuminant types having N−1 illuminant types at drive level 1.0 and the remaining illuminant type at drive level 0, then recording the N chromaticity coordinates resulting from each combination of illuminant types having N−2 illuminant types at drive level 1.0 with the remaining illuminant types at drive level 0 where all drive level 1.0 illuminant types are adjacent in the circular order and all drive level 0 illuminant types are adjacent in the circular order, and then repeating similarly to this N−2 step iteratively for N−3 etc. until only one of the N illuminant types is at drive level 1.0 for each of the N recorded chromaticity coordinates. When each chromaticity coordinate is recorded the corresponding drive level of each illuminant type (i.e., 0 or 1) is likewise recorded with it. The z-axis values of the three-dimensional surfaces is calculated from C by determining a three closest recorded chromaticity coordinates to C that form a triangle enclosing C but not enclosing any other recorded chromaticity coordinate, then using the position of C within the triangle to interpolate the drive level of each illuminant type at the recorded chromaticity coordinates forming the vertices of the triangle using barycentric interpolation or similar means. Illuminant drive level set $D^I$ combines drive levels for all illuminant types in a column vector of rank N, where each drive level is the z-axis value for the three-dimensional surface corresponding to that illuminant type. Equation 4 calculates the luminous intensity $A^I$ using the $Y^I$ values computed in Equation 2.

$$A^I = [Y_1^I \ldots Y_N^I] D^I \quad \text{Equation 4}$$

In some embodiments, Initialize Translator 902 performs the following calculations to implement a filter translator that converts from chromaticity to a filter drive level set and a luminous transmittance when all illuminants have drive level 1.0. Equation 5 uses standard color matching functions to calculate an $XYZ^F$ tristimulus value for each filter type as illuminated by all illuminant types at maximum intensity. In some embodiments, tristimulus values $XYZ^F$ for each filter type are pre-calculated and stored in a data memory.

$$\begin{cases} X_i^F = \sum_{j=1}^{N} \sum_{\lambda} V_{i,j}\bar{x}(\lambda) \\ Y_i^F = \sum_{j=1}^{N} \sum_{\lambda} V_{i,j}\bar{y}(\lambda) \\ Z_i^F = \sum_{j=1}^{N} \sum_{\lambda} V_{i,j}\bar{z}(\lambda) \end{cases} \quad \text{Equation 5}$$

$$i = [1 \ldots M]$$

For the case where M=3, i.e., there are 3 filter types, Equation 6 uses the $XYZ^F$ tristimulus values calculated by Equation 5 to convert an xy chromaticity C to a filter drive level set $D^F$ arranged as a column vector of rank 3, and a luminous intensity $A^I$ representing the maximum brightness at which C can be generated by the filters with all illuminant types at drive level 1.0.

$$D^F = \begin{bmatrix} X_1^F & X_2^F & X_3^F \\ Y_1^F & Y_2^F & Y_3^F \\ Z_1^F & Z_2^F & Z_3^F \end{bmatrix}^{-1} \begin{bmatrix} C_x \\ C_y \\ 1 - C_x - C_y \end{bmatrix} \quad \text{Equation 6}$$

$$A^F = [\, Y_1^F \;\; Y_2^F \;\; Y_3^F \,] D^F$$

For the case where M>3, i.e., there are 4 or more filter types, the proportions of each filter type necessary to generate a desired color is determined by computing a filter mapping as previously described for illuminant mapping, with $A^F$ determined as previously described in Equation 4.

In some embodiments, Generate Lookup Table 904 calculates an illuminant two-dimensional lookup table containing, for each combination of x and y dimensions, an illuminant drive level set calculated to produce the corresponding chromaticity with all filters at drive level 1.0. In some embodiments, the illuminant two-dimensional lookup table can be used to quickly convert a chromaticity to an illuminant drive level set by interpolating between table entries.

In some embodiments, Generate Lookup Table 904 calculates a filter two-dimensional lookup table containing, for each combination of x and y dimensions, a filter drive level set calculated to produce the corresponding chromaticity with all illuminants at drive level 1.0. In some embodiments, the filter two-dimensional lookup table can be used to quickly convert a chromaticity to a filter drive level set by interpolating between table entries.

Figure 10:
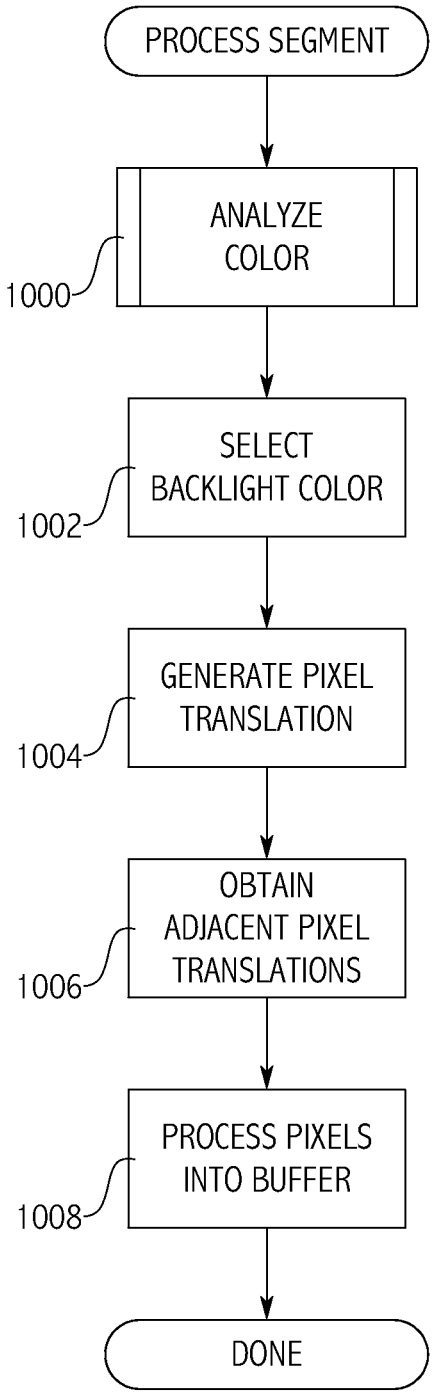
FIG. 10 is a flow chart illustrating an embodiment of a process for using an image segment to determine coordinated drive levels for LCD backlights and filters optimized for the image segment's color characteristics.

FIG. 10 is a flow chart illustrating an embodiment of a process for using an image segment to determine coordinated drive levels for LCD backlights and filters optimized for the image segment's color characteristics. In some embodiments, the process of FIG. 10 is used to implement 806 of FIG. 8. In the example shown, Analyze Color 1000 uses the segment image data to determine an allowable backlight color gamut. Select Backlight Color 1002 uses the allowable backlight color gamut and adjacent segment allowable backlight color to determine a specific backlight color within the allowable backlight color gamut. Generate Pixel Translation 1004 determines the color translation matrix necessary to drive filter transmittance which combined with the specific backlight color achieves the image segment's color characteristics. Obtain Adjacent Pixel Translations 1006 acquires adjacent segment pixel translations to assist in smooth transitions between adjacent segments. Process Pixels Into Buffer 1008 uses the pixel translation matrix and adjacent pixel translation matrices to process each pixel, with the actual translation for each pixel determined in part by its proximity to a segment edge bordering an adjacent segment.

In some embodiments, Select Backlight Color 1002 determines illuminant drive levels for the specific backlight color using the illuminant translation previously described in FIG. 9 to convert a chromaticity to an illuminant drive level set. In some embodiments, illuminant translation is accomplished using a lookup table. In some embodiments, illuminant translation is accomplished by calculation without a lookup table. In some embodiments, the allowable backlight color gamut from adjacent segments is compared with the allowable backlight color gamut from the current segment to determine an overlap region. In some embodiments, the specific backlight color is selected from those within the overlap region that minimize backlight intensity. In some embodiments, the allowable backlight color gamut for each segment is weighted according to the total image intensity of the segment. In some embodiments, the specific backlight color is selected to be one of a set of predetermined backlight colors. In some embodiments, a disjoint overlap region is used to determine the specific backlight color minimizing the chromaticity distance to the edge of each adjacent allowable backlight color gamut. In some embodiments, the specific backlight color is set to the maximum intensity point. In some embodiments, the specific backlight color is selected to be similar to a specific backlight color from a previously displayed image segment. In some embodiments, the specific backlight color is based in part on hysteresis.

In some embodiments, a specific backlight color is adjusted to create a visually smooth spatial transition between color and intensity of a display pixel for the backlight and color and intensity of a nearby display pixel for an adjacent backlight. For example, the spatial transition comprises a gradient backlight color change over a region of sequentially adjacent segments. In some embodiments, the region of sequentially adjacent segments includes only directly adjacent segments. In some embodiments, the gradient backlight color change is linear with distance. In some embodiments, the gradient backlight color change is non-linear with distance. In various embodiments, the gradient backlight color change comprises an intensity change, a chromaticity change, or both an intensity and a chromaticity change. In some embodiments, a windowing function is used to provide the gradient backlight color change. In some embodiments, the windowing function employs Gaussian weighting. In some embodiments, an intensity difference threshold is used to control the windowing function, wherein an intensity difference exceeding the intensity difference threshold causes the windowing function to have a more abrupt transition between segments.

In some embodiments, Generate Pixel Translation 1004 uses a translation similar to the filter translation previously described in FIG. 9 to convert a chromaticity to a filter drive level set where the tristimulus values $XYZ^F$ of Equation 5 are weighted according to the illuminant drive levels of the specific backlight color. In some embodiments, one or more lookup tables are pre-calculated for the set of predetermined backlight colors of Select Backlight Color 1002. In some embodiments, lookup tables are calculated as required. In some embodiments, a lookup table cache allows less recently used lookup tables to be discarded, e.g. to reclaim data memory for other use. In some embodiments, an intermediate conversion is calculated by interpolating among two or more lookup.

In some embodiments, Obtain Adjacent Pixel Translations 1006 interpolates between the translation of Generate Pixel Translation 1004 and the translations of adjacent segments to obtain visually smooth spatial transitions between segments. In some embodiments, the interpolation is weighted by a distance between each pixel and the edge of the segment. In some embodiments, the interpolation uses a weighting that is non-linear in the distance.

In some embodiments, Process Pixels Into Buffer 1008 uses the translation of Generate Pixel Translation 1004 and/or Obtain Adjacent Pixel Translations 1006 to create a filter drive level set for each pixel in the image segment. In some embodiments, when a new translation for a new image segment cannot be completed within a required time interval (e.g. when processing a video stream) then a translation for a preceding image segment is used. In some embodiments, a temporal smoothing process is used to interpolate between a previous translation and a new translation. In some embodiments, the temporal smoothing process uses a non-linear ramp.

Figure 11:
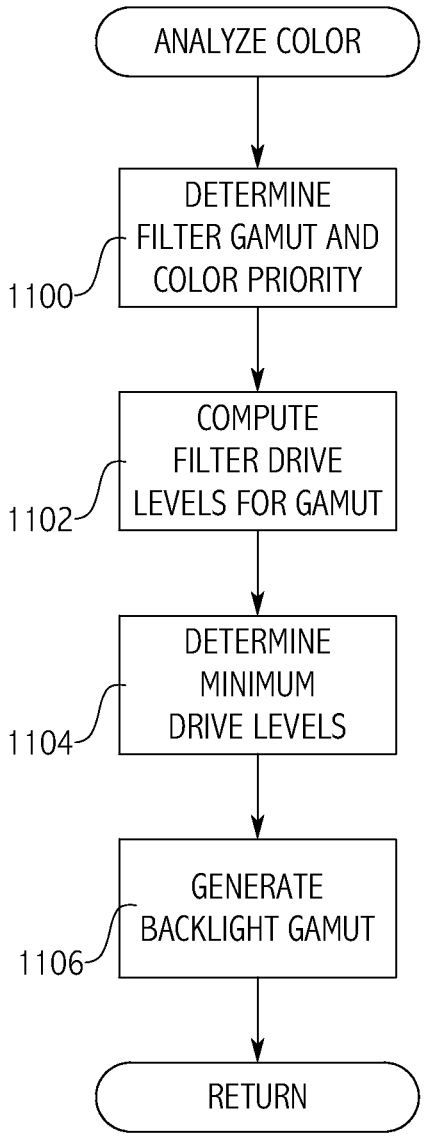
FIG. 11 is a flow chart illustrating an embodiment of a process for analyzing color.

FIG. 11 is a flow chart illustrating an embodiment of a process for analyzing color. In some embodiments, the process of FIG. 11 is used to implement 1000 of FIG. 10. In various embodiments, the process of FIG. 11 is used to calculate the combinations of minimum allowable backlight illuminant type drive levels for vertices 360, 362, 364, and 366 of FIG. 3B and/or for vertices of polygon 460 of FIG. 4B. In the example shown, Determine Filter Gamut And Color Priority 1100 processes each pixel in the image segment and accumulates a constraint gamut adjusted for intensity and density. Compute Filter Drive Levels For Gamut 1102 computes the necessary filter drive levels for the chromaticity associated with each vertex of the constraint gamut. Determine Minimum Drive Levels 1104 compares the required intensity of each vertex of the constraint gamut with the actual total transmittance available at the associated chromaticity to generate minimum backlight illuminant type drive levels for each. The minimum levels over all vertices are compared to determine an overall minimum for each backlight illuminant type drive level. Generate Backlight Gamut 1106 determines all combinations of backlight minimum and maximum illuminant type drive levels, computes a chromaticity for each, and generates a polygonal gamut representing allowable backlight chromaticity. In the example shown, a filter gamut is determined in step 1100 before a backlight gamut is determined in step 1106, but in FIG. 10 a specific backlight color is selected in step 1002 before a display pixel filter drive level set is created in step 1004, so the display pixel filter drive level set depends on the specific backlight color which depends on the backlight gamut which depends on the filter gamut.

In some embodiments, Determine Filter Gamut And Color Priority 1100 creates a constraint gamut G having K vertices where K is at least three, each vertex comprising a chromaticity coordinate (x, y) and a minimum luminous intensity a. In some embodiments, the xy points of the pixels in the image segment are examined to create an enclosing polygon containing the points. In some embodiments, the enclosing polygon is a triangle. In some embodiments, low intensity outlier points are omitted from the enclosing polygon. In some embodiments, low-density outlier points (e.g. a few bright points in a generally dark area) are omitted from the enclosing polygon. In some embodiments, a windowing function is used to determine outlier points. In some embodiments, G is chosen to allow an acceptable degree of image quality reduction. In some embodiments, G is chosen to maximize image quality. In some embodiments, G is determined in part from a global constraint gamut. In some embodiments, G is adjustable on the basis of selectable image quality preferences, e.g., to shift a tradeoff between image quality and power requirements. In some embodiments, G is adjustable on the basis of selectable image type preferences, e.g., whether the display is being used for television, movies, or video games.

In some embodiments, Compute Filter Drive Levels For Gamut 1102 performs the following calculations to determine a minimum filter drive level set $D^F$ from a constraint gamut G. $D^F$ is determined such that any color generated within G will have at least the luminous intensity of its vertices, as interpolated for coordinates in the gamut among the vertices. In Equation 7, constraint gamut G is defined in terms of its components, and filter drive level $D_k$ and maximum luminous intensity $A_k$ are determined for each vertex k of G, using the filter translation previously described in FIG. 9 to convert a chromaticity to a filter drive level set. In some embodiments, filter translation is accomplished using a lookup table. In some embodiments, filter translation is accomplished by calculation without a lookup table.

$$G = \begin{bmatrix} x_1 & x_2 & & x_K \\ y_1 & y_2 & \dots & y_K \\ a_1 & a_2 & & a_K \end{bmatrix} \quad \text{Equation 7}$$

-continued $$D_k = \text{filter_translate}(G_{xy,k})$$

$$A_k = [Y_1^{\bar{F}} \ \dots \ Y_M^{\bar{F}}]\, D_k$$

$$k = [1 \ \dots \ K]$$

In Equation 8, each column vector $T_k$ comprises a minimum filter drive level set for constraint gamut vertex k, computed by scaling the filter drive level set by the ratio of the luminous intensity requirement to the luminous intensity availability. Column vector H comprises a minimum filter drive level set for the combined constraint gamut vertices, computed by determining the maxima of $T_k$ for each filter.

$$T_k = D_k \frac{G_{a,k}}{A_k} \quad \text{Equation 8}$$

$$H = \begin{bmatrix} \max(T_{1,k}) \\ \max(T_{2,k}) \\ \vdots \\ \max(T_{m,k}) \end{bmatrix}$$

$$k = [1 \ \dots \ K]$$

In some embodiments, Determine Minimum Drive Levels 1104 uses the following calculations to determine a minimum drive level for each illuminant in the backlight. In Equation 9, column vector L comprises a minimum illuminant drive level set for the combined vertices of the constraint gamut, computed by determining the maxima of the minimum filter drive levels H as weighted by P, the proportion of each filter's contribution to the total light from each illuminant type.

$$L = \begin{bmatrix} \max(P_{1,1}H_1, \dots, P_{M,1}H_M) \\ \max(P_{1,2}H_1, \dots, P_{M,2}H_M) \\ \vdots \\ \max(P_{1,N}H_1, \dots, P_{M,N}H_M) \end{bmatrix} \quad \text{Equation 9}$$

In some embodiments, Generate Backlight Gamut 1106 computes a series of chromaticity points to generate the allowable backlight gamut. Equation 10 calculates the first point using the minimum illuminant type drive level set L from Equation 9 to weight the tristimulus values $XYZ^I$ from Equation 2.

$$\begin{cases} x = \dfrac{\sum_{j=1}^{N} L_j X_j^I}{\sum_{j=1}^{N} L_j (X_j^I + Y_j^I + Z_j^I)} \\ y = \dfrac{\sum_{j=1}^{N} L_j Y_j^I}{\sum_{j=1}^{N} L_j (X_j^I + Y_j^I + Z_j^I)} \end{cases} \quad \text{Equation 10}$$

Subsequent points are calculated using Equation 10 by replacing each possible permutation of one or more drive levels in L with 1.0 until the final chromaticity is plotted at the maximum intensity point with all drive levels at 1.0.

Points found to lie within the polygon formed by previously computed points are discarded. For example, the polygon comprises a maximum of $2^N$ points. The result is an allowable backlight color gamut representing backlight colors that, when transmitted through the filters, meet the constraint gamut requirements.

Figure 12:
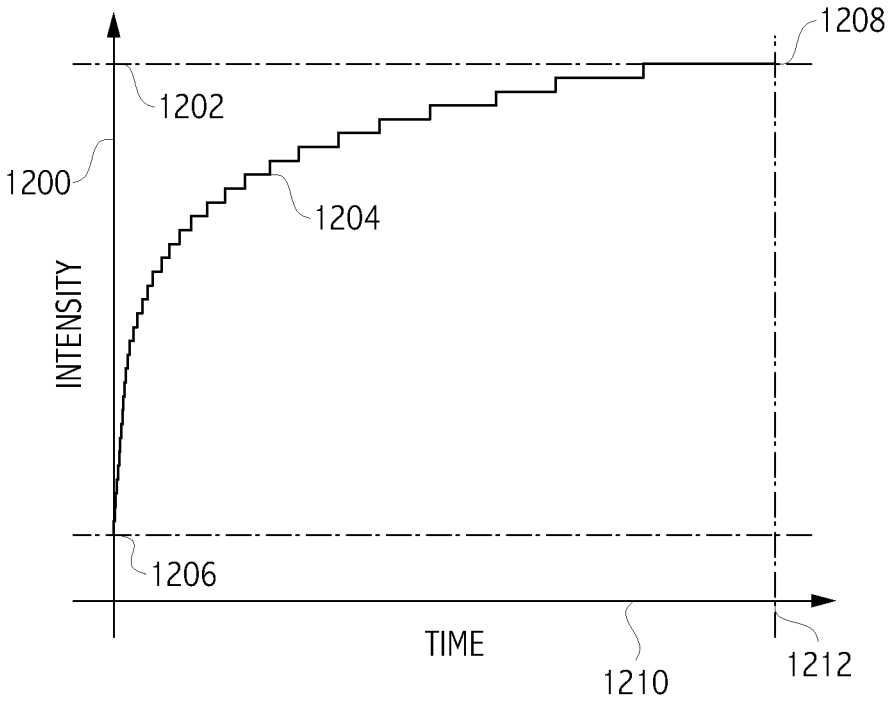
FIG. 12 is a graph illustrating an embodiment of a non-linear ramp, wherein intensity is modified by uniform steps at monotonically increasing intervals.

FIG. 12 is a graph illustrating an embodiment of a non-linear ramp, wherein intensity is modified by uniform steps at monotonically increasing intervals. In some embodiments, backlight intensity and color changes are accomplished using a similar ramp. In the example shown, intensity is plotted on vertical axis 1200 against time on horizontal axis 1210. Point 1206 corresponds to an initial intensity before the transition begins. Point 1208 corresponds to the end of the transition at final intensity 1202 and time 1212. Curve 1204 plots an example transition, wherein intensity increases by uniform steps at monotonically increasing intervals.

Figure 13:
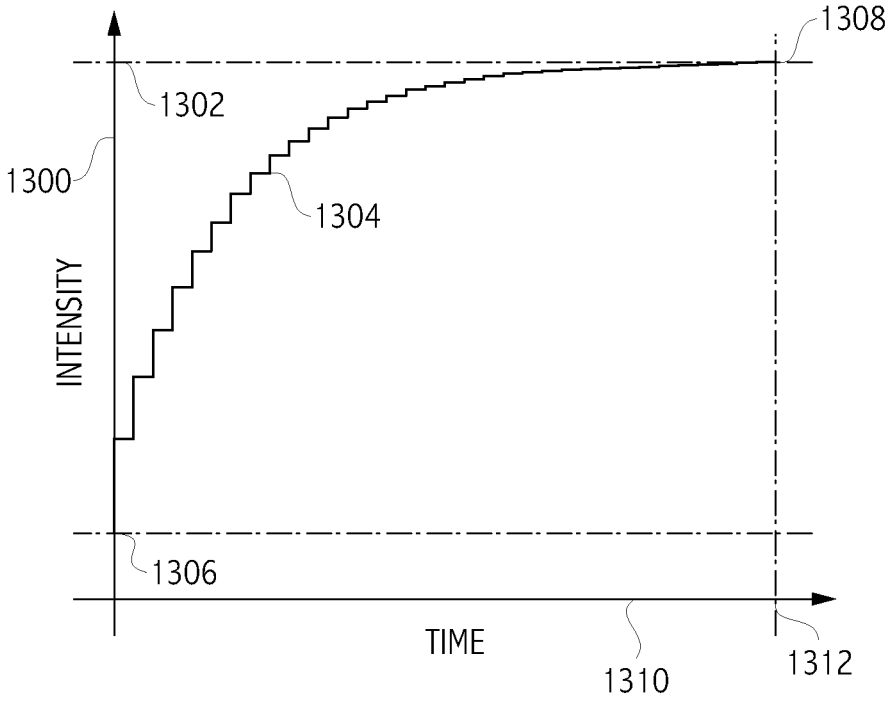
FIG. 13 is a graph illustrating an embodiment of a non-linear ramp, wherein intensity is modified by monotonically decreasing steps at uniform intervals.

FIG. 13 is a graph illustrating an embodiment of a non-linear ramp, wherein intensity is modified by monotonically decreasing steps at uniform intervals. In some embodiments, backlight intensity and color changes are accomplished using a similar ramp. In some embodiments, the backlight color and the backlight intensity level are sequentially modified to perform a visually smooth temporal transition between the desired color and intensity for a display pixel and a subsequent desired color and intensity for the display pixel. For example, the ramp consists of at least three steps over time, and the level at each step corresponds to an interpolation between the initial and final backlight color and/or intensity. In some embodiments, the interpolation comprises a variable mixture of the initial and final backlight colors and/or intensities. In some embodiments, the level at each step is monotonically increasing over time. In various embodiments, the time interval between steps is substantially uniform, increasing over time, decreasing over time, not uniform, or any other time interval. In the example shown, intensity is plotted on vertical axis 1300 against time on horizontal axis 1310. Point 1306 corresponds to an initial intensity before the transition begins. Point 1308 corresponds to the end of the transition at final intensity 1302 and time 1312. Curve 1304 plots an example transition, wherein intensity increases by monotonically increasing steps at uniform intervals.

Figure 14:
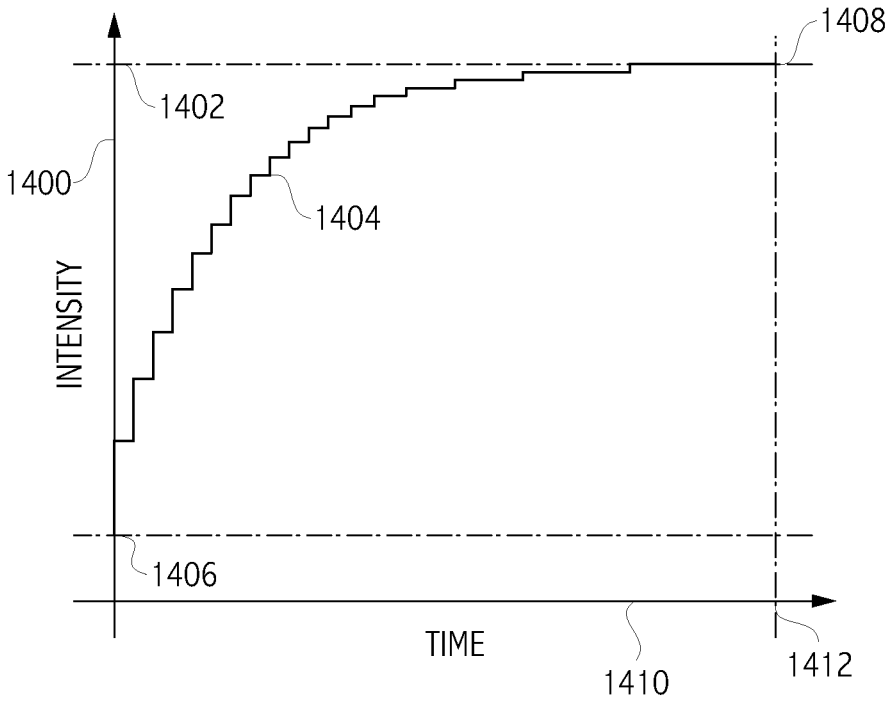
FIG. 14 is a graph illustrating an embodiment of a non-linear ramp, wherein intensity is modified by monotonically decreasing steps at monotonically increasing intervals.

FIG. 14 is a graph illustrating an embodiment of a non-linear ramp, wherein intensity is modified by monotonically decreasing steps at monotonically increasing intervals. In some embodiments, backlight intensity and color changes are accomplished using a similar ramp. In some embodiments, the backlight color and the backlight intensity level are sequentially modified to perform a visually smooth temporal transition between the desired color and intensity for a display pixel and a subsequent desired color and intensity for the display pixel. For example, the ramp consists of at least three steps over time, and the level at each step corresponds to an interpolation between the initial and final backlight color and/or intensity. In some embodiments, the time interval between steps is monotonically increasing over time. In various embodiments, differences between levels of adjacent steps are substantially uniform, increasing over time, decreasing over time, not uniform, or any other appropriate difference between levels. In the example shown, intensity is plotted on vertical axis 1400 against time on horizontal axis 1410. Point 1406 corresponds to an initial intensity before the transition begins. Point 1408 corresponds to the end of the transition at final intensity 1402 and time 1412. Curve 1404 plots an example transition, wherein intensity increases by monotonically increasing steps at monotonically increasing intervals.

Figure 15:
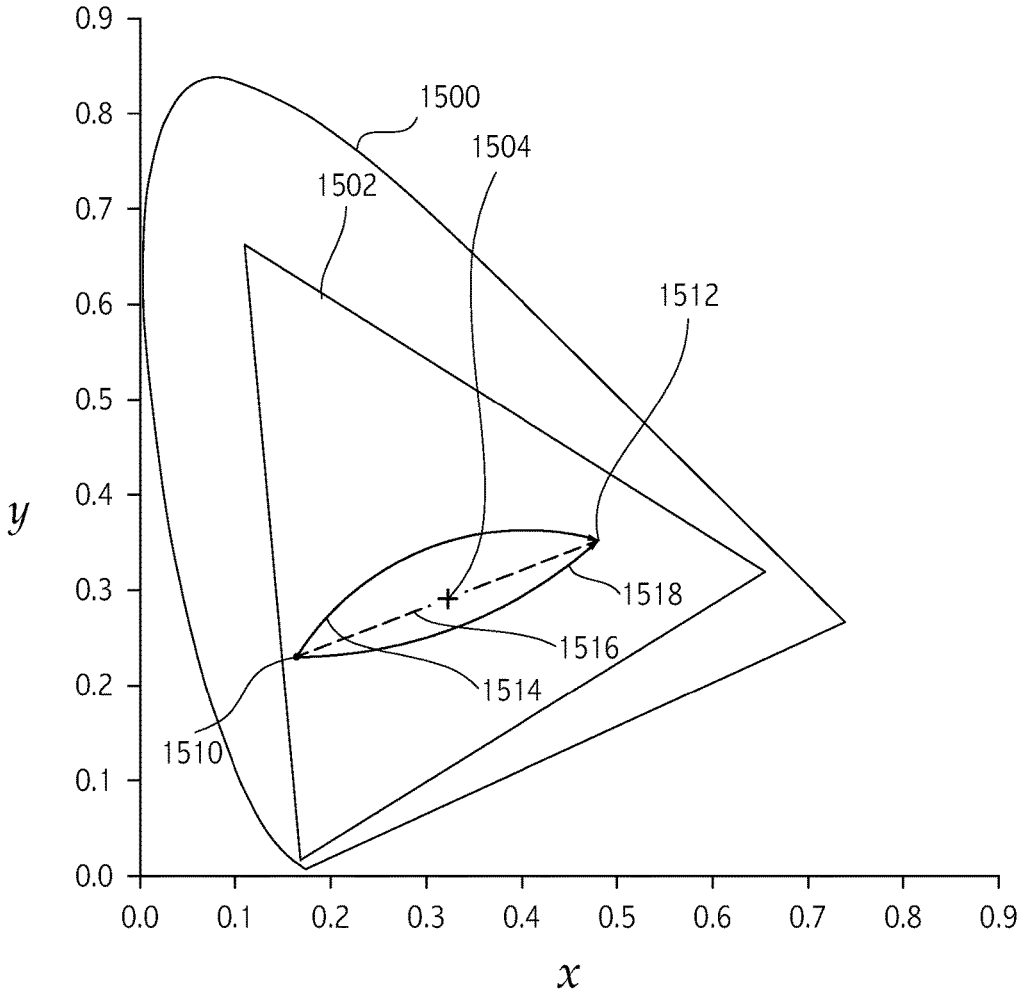
FIG. 15 is a graph illustrating an embodiment of the CIE 1931 xy chromaticity diagram showing a set of paths between a pair of points.

FIG. 15 is a graph illustrating an embodiment of the CIE 1931 xy chromaticity diagram showing a set of paths between a pair of points. In some embodiments, display color changes are made to conform to a selected path from the set of paths. In the example shown, gamut 1502 having white point 1504 is shown within the human color gamut boundary depicted by closed curve 1502. Beginning point 1510 corresponds to an initial color before a transition. Ending point 1512 corresponds to a final color after a transition. Line 1516 shows a straight-line path between the initial and final colors. For example, a transition following this path passes through the white point, increasing luminous intensity during the middle of the transition and possibly creating a visual artifact. Arc 1514 shows a transition path avoiding the white point. For example, a transition following this path approximately follows a contour of constant luminance by increasing a proportion of green during the middle of the transition. Arc 1518 shows a transition path avoiding the white point. For example, a transition following this path approximately follows a contour of constant luminance by maintaining an increased proportion of blue and red color components during the middle of the transition.

Figure 16:
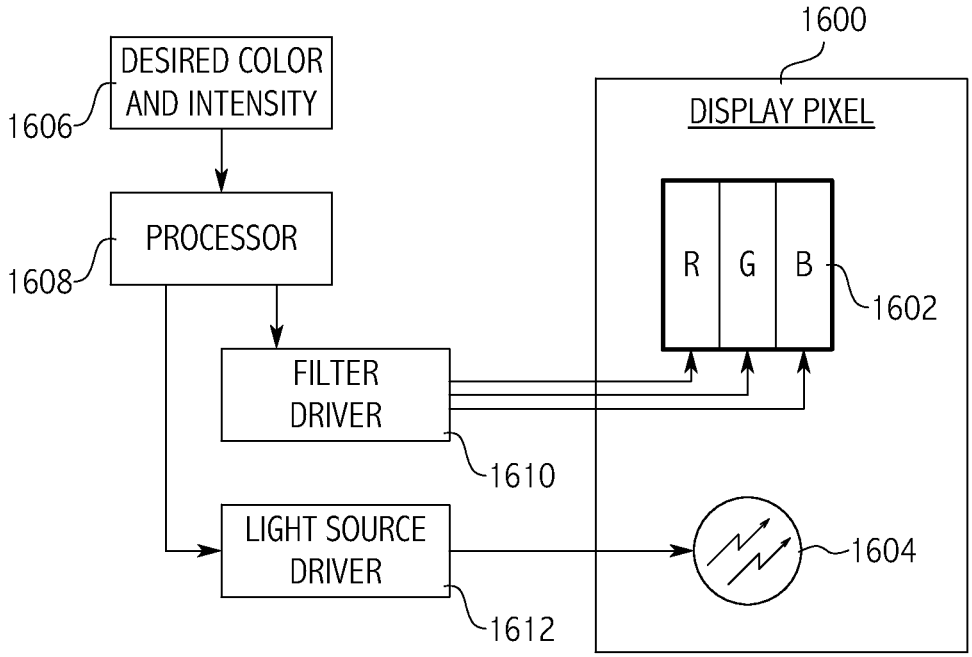
FIG. 16 is a block diagram illustrating an embodiment of a system for coordinated color control of LCD backlight and filters.

FIG. 16 is a block diagram illustrating an embodiment of a system for coordinated color control of LCD backlight and filters. In the example shown, Display Pixel 1600 comprises filter set 1602 and a backlight 1604. Desired Color And Intensity 1606 is connected to processor 1608. Processor 1608 connects to Filter Driver 1610 and Light Source Driver 1612. Filter Driver 1610 connects to each filter of filter set 1602 within Display Pixel 1600. Light Source Driver 1612 connects to backlight 1604 within Display Pixel 1600. The filters of filter set 1602 are labeled "R", "G", and "B" referring to example filter colors Red, Green, and Blue respectively.

Desired Color And Intensity 1606 provides desired color and intensity information for Display Pixel 1600 to Processor 1608. Processor 1608 is configured to determine a backlight color and intensity level for backlight 1604 and an array of filter levels for filter set 1602 that target the desired color and intensity. In some embodiments, the array of filter levels is determined based at least in part on the backlight color and intensity level. For example, processor 1608 determines a backlight color and intensity level for backlight 1604. The determined backlight color and intensity are achieved by processor 1608 providing instructions or electronic commands to light source driver 1612 that sets color and intensity as output by backlight 1604. Backlight 1604 illuminates filter set 1602. Filter set 1602 modifies the color and intensity of the input illumination produced by backlight 1604. Processor 1608 provides instructions or electronic commands to filter driver 1610 that sets color and intensity transmitted by filter set 1602 given an input illumination color and intensity.

Figure 17:
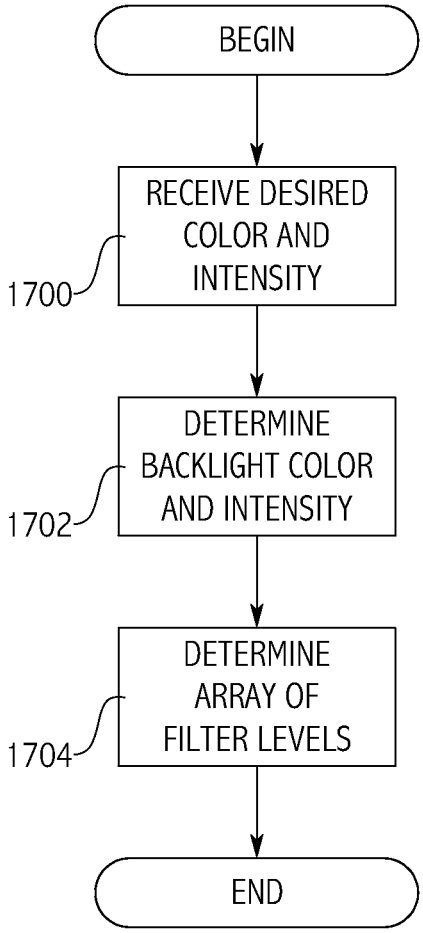
FIG. 17 is a flow chart illustrating an embodiment of a process for coordinated color control of LCD backlight and filters.

FIG. 17 is a flow chart illustrating an embodiment of a process for coordinating color among LCD backlights and filters. In the example shown, in 1700 a desired color and intensity is received. For example, the received color and intensity is for a display pixel or the received color and intensity comprises a desired image or video frame. In 1702, a backlight color and intensity level is determined. In some embodiments, the backlight color and intensity is based at least in part on the desired color and intensity. In 1704, an array of filter levels that target the desired color and intensity for the display pixel is determined. In some embodiments, the array of filter levels is determined based at least in part on the backlight color and intensity level. In some embodiments, the array of filter levels is determined from the backlight color and intensity as previously described for step 1004 Generate Pixel Translation of FIG. 10. In some embodiments, the array of filter levels is determined by calculating an emitted tristimulus value for each filter as illuminated by the backlight color and intensity, then calculating a proportion of the emitted tristimulus values so that the combined emitted light matches the received color chromaticity, assigning a filter level for each filter according to its calculated proportion, and then scaling the array of filter levels so that the combined emitted light matches the received color luminous intensity.

Although the foregoing embodiments have been described in some detail for purposes of clarity of understanding, the invention is not limited to the details provided. There are many alternative ways of implementing the invention. The disclosed embodiments are illustrative and not restrictive.

What is claimed is:

1. A system for coordinated color control of LCD backlight and filters, comprising:

a first pixel, wherein the first pixel is a first one of a plurality of pixels of a desired image, wherein the first pixel is associated with a first segment of the desired image;

a first light source driver, wherein the first light source driver sets a first pixel backlight color for the first segment;

a first filter driver, wherein the first filter driver sets a first filter level array for a first of three or more filters for the first pixel;

a second pixel, wherein the second pixel is a second one of the plurality of pixels of the desired image, wherein the second pixel is associated with a second segment of the desired image, wherein the first segment and the second segment are not located in an overlapping location of the desired image, wherein the second segment is adjacent to the first segment;

a second light source driver, wherein the second light source driver sets a second pixel backlight color for the second segment, wherein the second pixel backlight color differs from the first pixel backlight color;

a second filter driver, wherein the second filter driver sets a second filter level array for a second of three or more filters for the second pixel; and a processor, wherein the processor is configured to:

cause initialization of backlight;

receive frame data;

divide frame into segments;

determine an overlap region of an allowable backlight color gamut for the first segment and an allowable backlight color gamut for the second segment;

select the first pixel backlight color to enable reproduction of a first pixel desired color, wherein the first pixel backlight color corresponds to a first overlap pixel backlight color, the first overlap pixel backlight color being selected from pixel backlight colors of the overlap region, the first overlap pixel backlight color having a smaller backlight intensity than a second overlap pixel backlight color of the overlap region, an intensity point of the first overlap pixel backlight color being set to a greater value than an intensity point of the second overlap pixel backlight color;

generate a first pixel translation to translate the first pixel backlight color to a desired chromaticity based on image data associated with the first segment;

determine the second pixel backlight color to enable reproduction of a second pixel desired color;

generate a second pixel translation to translate the second pixel backlight color to a desired chromaticity based on image data associated with the second segment; generate a third pixel translation to smooth transitions between the first segment and the second segment based at least in part on the first pixel translation and the second pixel translation;

determine a setting of the first filter level array based at least in part on the third pixel translation and the first pixel backlight color;

provide the setting of the first filter level array to filter drivers;

determine whether backlight illuminants have drifted beyond a threshold; and in the event that the backlight illuminants have drifted beyond a threshold, cause reinitialization of the backlight.

2. A system as in claim 1, wherein the desired image comprises a frame of a video stream.

3. A system as in claim 1, wherein a backlight source emitting the first pixel backlight color illuminates a first set of the plurality of pixels of the desired image.

4. A system as in claim 1, wherein the first light source driver controls a first light source comprised of three or more illuminant types, and wherein the first light source driver sets the first pixel backlight color by setting a drive level for each of the three or more illuminant types.

5. A system as in claim 4, wherein the drive level for each of the three or more illuminant types is set targeting one or more of the following: a predetermined color gamut, a predetermined luminous efficacy, and a predetermined image quality.

6. A system as in claim 1, wherein the first pixel backlight color is sequentially modified to perform a visually smooth temporal transition between the first pixel desired color for the first pixel and a subsequent desired color for the first pixel.

7. A method for coordinated color control of LCD backlight and filters, comprising:

causing initialization of backlight;

receiving frame data;

dividing frame into segments;

determining an overlap region of an allowable backlight color gamut for a first segment of a desired image and an allowable backlight color gamut for a second segment of the desired image, wherein the first segment and the second segment are not located in an overlapping location of the desired image, wherein the first segment is adjacent to the second segment;

selecting a first pixel backlight color to enable reproduction of a first pixel desired color, wherein a first light source driver sets the first pixel backlight color for the first segment, wherein the first pixel is a first one of a plurality of pixels of the desired image, wherein the first pixel backlight color corresponds to a first overlap pixel backlight color, the first overlap pixel backlight color being selected from pixel backlight colors of the overlap region, the first overlap pixel backlight color having a smaller backlight intensity than a second overlap pixel backlight color of the overlap region, an intensity point of the first overlap pixel backlight color being set to a greater value than an intensity point of the second overlap pixel backlight color, and wherein a first filter driver sets a first filter level array for a first of three or more filters for the first pixel, wherein the first pixel is associated with the first segment;

determining a second pixel backlight color to enable reproduction of a second pixel desired color, wherein a second light source driver sets the second pixel backlight color for the second segment, wherein the second pixel backlight color differs from the first pixel backlight color, wherein the second pixel is a second one of the plurality of pixels of the desired image, wherein a second filter driver sets a second filter level array for a second of three or more filters for the second pixel, wherein the second pixel is associated with the second segment;

generating a first pixel translation to translate the first pixel backlight color to a desired chromaticity based on image data associated with the first segment;

generating a second pixel translation to translate the second pixel backlight color to a desired chromaticity based on image data associated with the second segment;

generating a third pixel translation to smooth transitions between the first segment and the second segment based at least in part on the first pixel translation and the second pixel translation;

determining a setting of the first filter level array based at least in part on the third pixel translation and the first pixel backlight color, providing the setting of the first filter level array to filter drivers;

determining whether backlight illuminants have drifted beyond a threshold;

and in the event that the backlight illuminants have drifted beyond a threshold, causing reinitialization of the backlight.

8. A method as in claim 7, wherein the desired image comprises a frame of a video stream.

9. A method as in claim 7, wherein a backlight source emitting the first pixel backlight color illuminates a first set of the plurality of pixels of the desired image.

10. A method as in claim 7, wherein the first light source driver controls a first light source comprised of three or more illuminant types, and wherein the first light source driver sets the first pixel backlight color by setting a drive level for each of the three or more illuminant types.

11. A method as in claim 10, wherein the drive level for each of the three or more illuminant types is set targeting one or more of the following: a predetermined color gamut, a predetermined luminous efficacy, and a predetermined image quality.

12. A method as in claim 7, wherein the first pixel backlight color is sequentially modified to perform a visually smooth temporal transition between the first pixel desired color for the first pixel and a subsequent desired color for the first pixel.

13. A computer program product for coordinated color control of LCD backlight and filters, the computer program product being embodied in a non-transitory computer readable storage medium and comprising computer instructions for:

causing initialization of backlight;

receiving frame data;

dividing frame into segments;

determining an overlap region of an allowable backlight color gamut for a first segment of a desired image and an allowable backlight color gamut for a second segment of the desired image, wherein the first segment and the second segment are not located in an overlapping location of the desired image, wherein the first segment is adjacent to the second segment; selecting a first pixel backlight color to enable reproduction of a first pixel desired color, wherein a first light source driver sets the first pixel backlight color for the first segment, wherein the first pixel is a first one of a plurality of pixels of the desired image, wherein the first pixel backlight color corresponds to a first overlap pixel backlight color, the first overlap pixel backlight color being selected from pixel backlight colors of the overlap region, the first overlap pixel backlight color having a smaller backlight intensity than a second overlap pixel backlight color of the overlap region, an intensity point of the first overlap pixel backlight color being set to a greater value than an intensity point of the second overlap pixel backlight color, and wherein a first filter driver sets a first filter level array for a first of three or more filters for the first pixel, wherein the first pixel is associated with the first segment;

determining a second pixel backlight color to enable reproduction of a second pixel desired color, wherein a second light source driver sets the second pixel backlight color for the second segment, wherein the second pixel backlight color differs from the first pixel backlight color, wherein the second pixel is a second one of the plurality of pixels of the desired image, wherein a second filter driver sets a second filter level array for a second of three or more filters for the second pixel, wherein the second pixel is associated with the second segment;

generating a first pixel translation to translate the first pixel backlight color to a desired chromaticity based on image data associated with the first segment;

generating a second pixel translation to translate the second pixel backlight color to a desired chromaticity based on image data associated with the second segment; generating a third pixel translation to smooth transitions between the first segment and the second segment based at least in part on the first pixel translation and the second pixel translation;

determining a setting of the first filter level array based at least in part on the third pixel translation and the first pixel backlight color, providing the setting of the first filter level array to filter drivers;

determining whether backlight illuminants have drifted beyond a threshold; and in the event that the backlight illuminants have drifted beyond a threshold, causing reinitialization of the backlight.

14. A computer program product as in claim 13, wherein the desired image comprises a frame of a video stream.

15. A computer program product as in claim 13, wherein a backlight source emitting the first pixel backlight color illuminates a first set of the plurality of pixels of the desired image.

16. A computer program product as in claim 13, wherein the first light source driver controls a first light source comprised of three or more illuminant types, and wherein the first light source driver sets the first pixel backlight color by setting a drive level for each of the three or more illuminant types.

17. A computer program product as in claim 16, wherein the drive level for each of the three or more illuminant types is set targeting one or more of the following: a predetermined color gamut, a predetermined luminous efficacy, and a predetermined image quality.

18. A computer program product as in claim 13, wherein the first pixel backlight color is sequentially modified to perform a visually smooth temporal transition between the first pixel desired color for the first pixel and a subsequent desired color for the first pixel.

19. A system as in claim 1, wherein the first pixel backlight color depends at least in part on the first pixel desired color.

20. A system as in claim 1, wherein the third pixel translation is generated based at least in part on a distance of the first pixel to a bordering segment, the bordering segment corresponding to a common border between the first and second segments.

21. A system as in claim 1, wherein:

the allowable backlight color gamut for the first segment is weighted based on a total image intensity of the first segment; and the allowable backlight color gamut for the second segment is weighted based on a total image intensity of the second segment.

* * * * *